US006637611B2

(12) United States Patent
Luch

(10) Patent No.: US 6,637,611 B2
(45) **Date of Patent: *Oct. 28, 2003**

(54) SNAP-ON, SCREW-OFF CAP AND CONTAINER NECK

(75) Inventor: Daniel Luch, Morgan Hill, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/210,716

(22) Filed: Jul. 30, 2002

(65) Prior Publication Data

US 2002/0190021 A1 Dec. 19, 2002

Related U.S. Application Data

(63) Continuation of application No. 09/746,882, filed on Dec. 22, 2000, now Pat. No. 6,439,412, which is a continuation of application No. 09/356,063, filed on Jul. 19, 1999, now Pat. No. 6,173,853, which is a continuation of application No. 09/071,625, filed on May 1, 1998, now Pat. No. 5,975,321, which is a continuation-in-part of application No. 08/781,453, filed on Jan. 10, 1997, now Pat. No. 5,755,348, which is a continuation of application No. 08/456,741, filed on Jun. 1, 1995, now abandoned, which is a division of application No. 08/029,177, filed on Mar. 10, 1993, now Pat. No. 5,456,376, which is a continuation-in-part of application No. 07/830,133, filed on Jan. 31, 1992, now Pat. No. 5,267,661, which is a continuation-in-part of application No. 07/772,945, filed on Oct. 8, 1991, now Pat. No. 5,213,224, which is a continuation-in-part of application No. 07/565,638, filed on Aug. 9, 1990, now Pat. No. 5,190,178.

(51) Int. Cl.[7] ..... B65D 41/34

(52) U.S. Cl. ..... 215/256; 215/44; 215/45; 215/307; 215/318; 215/320; 215/329; 215/354

(58) Field of Search ..... 215/44, 45, 252, 215/253, 254, 256, 307, 318, 320, 329, 330, 341, 354, 356, 357

(56) References Cited

U.S. PATENT DOCUMENTS

| | | | | |
|---|---|---|---|---|
| 1,630,687 A | | 5/1927 | Aulbach | |
| 2,181,340 A | | 11/1939 | Plumb | |
| 3,022,917 A | | 2/1962 | Montgomery | |
| 3,181,725 A | | 5/1965 | Friedl | |
| 3,223,269 A | * | 12/1965 | Williams | 215/318 |

(List continued on next page.)

FOREIGN PATENT DOCUMENTS

| | | |
|---|---|---|
| CA | 812597 | 5/1969 |
| DE | 1154369 | 9/1963 |

(List continued on next page.)

*Primary Examiner*—Stephen K. Cronin
(74) *Attorney, Agent, or Firm*—Dorsey & Whitney LLP

(57) ABSTRACT

A tamper-evident, snap-on, screw-off closure is used with a specially shaped container neck. One neck has double lead external threads and, below the threads, a conical wall having external ratchet teeth. The closure has an upper skirt having internal threads mating with the neck threads. A conical lower skirt is connected to the upper skirt by a plurality of frangible bridges. The lower skirt has internal ratchet teeth to mate with the neck ratchet teeth. The cap skirt threads are double pitch and slightly over 360° in length. When the cap is applied to the neck it snaps on in two stages. The lower skirt has a tear tab which, when pulled, fractures the lower skirt on a vertical line. Continued pulling on the tab sequentially fractures the bridges. Another neck has a neck stretch with multiple neck threads and a locking wall below the neck stretch with a plurality of external teeth. The closure has an upper skirt with multiple closure threads which mate with the neck threads and a tamper-evidencing band with a plurality of internal teeth shaped and positioned to engage the external teeth. The teeth are shaped to guide the teeth into side-by-side interengage during axial application of the cap to the neck.

33 Claims, 11 Drawing Sheets

U.S. PATENT DOCUMENTS

| | | | | | |
|---|---|---|---|---|---|
| 3,695,475 | A | * | 10/1972 | Ruekberg | 215/217 |
| 3,837,518 | A | * | 9/1974 | Gach | 215/365 |
| 3,844,443 | A | * | 10/1974 | Cudzik | 220/296 |
| 3,874,540 | A | * | 4/1975 | Hidding | 215/252 |
| 3,885,696 | A | | 5/1975 | Eberhardt | |
| 3,901,403 | A | | 8/1975 | Menke | |
| 3,901,404 | A | | 8/1975 | Feldman | |
| 3,902,621 | A | * | 9/1975 | Hidding | 215/252 |
| 3,980,195 | A | * | 9/1976 | Fillmore | 215/256 |
| 3,997,077 | A | | 12/1976 | Mill et al. | |
| 4,057,160 | A | | 11/1977 | Victor et al. | |
| 4,078,700 | A | | 3/1978 | Hidding | |
| 4,177,906 | A | | 12/1979 | Von Hagel | |
| 4,180,175 | A | | 12/1979 | Virog, Jr. et al. | |
| 4,241,841 | A | * | 12/1980 | Boller | 215/252 |
| 4,269,320 | A | | 5/1981 | Virog, Jr. et al. | |
| 4,298,129 | A | * | 11/1981 | Stull | 215/224 |
| 4,299,330 | A | | 11/1981 | Walter | |
| 4,301,937 | A | | 11/1981 | Von Hagel | |
| 4,354,609 | A | | 10/1982 | Hidding | |
| 4,385,708 | A | * | 5/1983 | Curry | 215/256 |
| 4,399,926 | A | | 8/1983 | Eidels-Dubovoy | |
| 4,402,415 | A | * | 9/1983 | Hopley | 215/48 |
| 4,448,319 | A | * | 5/1984 | Kern | 215/329 |
| 4,484,687 | A | | 11/1984 | Bullock, III | |
| 4,489,843 | A | | 12/1984 | Drozd, Jr. | |
| 4,494,664 | A | | 1/1985 | Guala | |
| 4,496,066 | A | | 1/1985 | Bullock, III | |
| 4,498,597 | A | | 2/1985 | Bashour | |
| 4,530,437 | A | * | 7/1985 | Gray et al. | 215/252 |
| 4,534,479 | A | | 8/1985 | Conti | |
| 4,534,480 | A | | 8/1985 | Santostasi et al. | |
| 4,540,102 | A | * | 9/1985 | Wiedmer | 215/344 |
| 4,548,329 | A | * | 10/1985 | Curry | 215/216 |
| 4,561,553 | A | * | 12/1985 | Crisci | 215/256 |
| 4,562,930 | A | | 1/1986 | Lecinski, Jr. et al. | |
| 4,567,992 | A | | 2/1986 | Davis | |
| 4,593,830 | A | | 6/1986 | Bullock | |
| 4,609,115 | A | | 9/1986 | Moore et al. | |
| 4,625,875 | A | * | 12/1986 | Carr et al. | 215/232 |
| 4,699,285 | A | | 10/1987 | Perne et al. | |
| 4,700,860 | A | * | 10/1987 | Li | 215/256 |
| 4,739,891 | A | | 4/1988 | Bullock, III | |
| 4,744,478 | A | * | 5/1988 | Hahn | 215/252 |
| 4,784,296 | A | | 11/1988 | Bullock | |
| 4,796,770 | A | | 1/1989 | Begley | |
| 4,815,617 | A | | 3/1989 | Cullum | |
| 4,828,128 | A | | 5/1989 | Tackles | |
| 4,844,250 | A | * | 7/1989 | Holoubek et al. | 222/107 |
| 4,848,613 | A | | 7/1989 | Nofer | |
| 4,911,316 | A | | 3/1990 | Tackles | |
| 4,930,647 | A | | 6/1990 | Dutt et al. | |
| 4,934,546 | A | | 6/1990 | Markley | |
| 4,946,055 | A | * | 8/1990 | Towns et al. | 215/254 |
| 4,981,230 | A | * | 1/1991 | Marshall et al. | 215/252 |
| 4,989,740 | A | * | 2/1991 | Vercillo | 215/252 |
| 5,020,683 | A | | 6/1991 | Strassheimer | |
| 5,027,964 | A | | 7/1991 | Banich, Sr. | |
| 5,050,754 | A | | 9/1991 | Marino | |
| 5,105,960 | A | | 4/1992 | Crisci et al. | |
| 5,129,530 | A | | 7/1992 | Fuchs | |
| 5,147,060 | A | | 9/1992 | Lima et al. | |
| 5,152,416 | A | | 10/1992 | Cassel | |
| 5,176,270 | A | | 1/1993 | Battagazzore | |
| 5,190,178 | A | * | 3/1993 | Luch | 215/256 |
| 5,213,224 | A | * | 5/1993 | Luch | 215/256 |
| 5,224,616 | A | | 7/1993 | Crisci | |
| 5,267,661 | A | | 12/1993 | Luch et al. | |
| 5,285,912 | A | | 2/1994 | Molinaro | |
| 5,307,945 | A | | 5/1994 | Hidding et al. | |
| 5,307,946 | A | | 5/1994 | Molinaro | |
| 5,385,252 | A | | 1/1995 | Hidding et al. | |
| 5,415,306 | A | | 5/1995 | Luch et al. | |
| 5,480,045 | A | | 1/1996 | Molinaro et al. | |
| 5,560,504 | A | | 10/1996 | Molinaro | |
| 5,593,055 | A | | 1/1997 | Repp et al. | |
| 5,630,520 | A | | 5/1997 | Luch et al. | |
| 5,687,866 | A | | 11/1997 | Luch et al. | |
| 5,690,243 | A | | 11/1997 | Molinaro | |
| 5,775,528 | A | | 7/1998 | Wohlgemuth et al. | |

FOREIGN PATENT DOCUMENTS

| | | |
|---|---|---|
| DE | 2356007 | 5/1974 |
| EP | 0118267 | 10/1986 |
| GB | 2105693 | 3/1983 |
| GB | 2114553 | 8/1983 |
| GB | 2264108 | 8/1993 |
| GB | 2265892 | 10/1993 |

* cited by examiner

SNAP-ON, SCREW-OFF CAP AND CONTAINER NECK

CROSS-REFERENCES TO RELATED APPLICATIONS

This application is a continuation of U.S. patent application Ser. No. 09/746,882, filed Dec. 22, 2000, now U.S. Pat. No. 6,439,412 which is a continuation of U.S. patent application Ser. No. 09/356,063, filed Jul. 19, 1999 and now U.S. Pat. No. 6,173,853, which is a continuation of U.S. patent application Ser. No. 09/071,625, filed May 1, 1998 and now U.S. Pat. No. 5,975,321, which is a continuation-in-part of U.S. patent application Ser. No. 08/781,453, filed Jan. 10, 1997 and now U.S. Pat. No. 5,755,348, which is a continuation of U.S. patent application Ser. No. 08/456,741, filed Jun. 1, 1995 and now abandoned, which is a divisional Ser. No. 08/029,177, filed Mar. 10, 1993 and now U.S. Pat. No. 5,456,376, which is a continuation-in-part of U.S. patent application Ser. No. 07/830,133, filed Jan. 31, 1992 and now U.S. Pat. No. 5,267,661, which is a continuation-in-part of U.S. patent application Ser. No. 07/772,945, filed Oct. 8, 1991 and now U.S. Pat. No. 5,213,224, which is a continuation-in-part of U.S. patent application Ser. No. 07/565,638, filed Aug. 9, 1990, now U.S. Pat. No. 5,190,178. The entire disclosures of the above-mentioned applications are hereby incorporated herein by reference

BACKGROUND OF THE INVENTION

1. Field of the Invention

This invention relates to a new and improved container closure and container neck structure and more particularly to a structure wherein the closure is applied with a single one-dimensional axial downward force onto the neck and is held in such position by a tamper-evident band. The consumer destroys a frangible connection between the cap and the band during initial removal, preferably by tearing away the band enabling the closure to be unscrewed from the container neck. When the cap is used for reclosure purposes, it may be screwed on and screwed off in the same manner as screw caps have heretofore been used.

2. Description of Related Art

Prior snap-on, screw-off structures may be classified under either of the following categories: (1) Those with thread engagement as initially applied; and (2) Those without.

The major advantages of the no-thread initial engagement systems are that they are conceptually simple, careful alignment of the closure and the container is not necessary upon application of the closure, and easy (low force) application is possible since no thread-jumping is required. This version can be an aesthetically pleasing, straight wall cap design, and good re-seal is achieved on reclosure because of the torque advantage of threads. On the other hand, the disadvantages of such a system are that it may be confusing to the consumer because initial removal is merely by lifting the cap off the neck but subsequent use requires twisting the cap relative to the neck. Further, it is difficult to use the system with a lined closure because of the height relationships between the finish and the cap, and finally the cap must be relatively tall, which forces the use of fine threads, which can be difficult to mold. None of these disadvantages are present in this invention.

A closure such as Crisci U.S. Pat. No. 4,561,553 has a number of problems. The tamper evident feature of the closure may be circumvented by being able to engage the threads of the neck and closure (thereby creating a mechanical advantage) and back off the cap while the tamper-evident band is intact. Secondly, the device is confusing to the consumer since the cap is screwed off during removal only by inwardly distorting the cap skirt. The cap is reapplied as a standard snap cap.

Full thread engagement as the cap is initially applied has a number of conceptual advantages. Consumer confusion is eliminated since initial removal is by unscrewing. A number of seal systems, including foil, full liner, plugs or other linerless seals can be used. However, full engagement systems heretofore have been difficult to achieve in practice. A disadvantage of a closure such as Carr U.S. Pat. No. 4,625,875 is that there is no practical, consistent means to orient the cap relative to the container so that, after application, the cap must be turned at least slightly to ensure a tight seal. This defeats the purpose of a push-on cap. Also, the use of a stretch snap-band tamper evident ring excessively increases the application force necessary to seat the cap.

The present invention provides full thread engagement by reason of unique thread design and, more particularly, a unique tamper-evident band (i.e., lower skirt portion) attached to the upper part of the cap by multiple bridges or by means of a continuous line of weakness between the cap and tear band, as well as a means of orienting closure and bottle threads to achieve registration prior to straight axial application.

The present invention has considerable advantages over prior structures for the reasons above noted, among others.

BRIEF SUMMARY OF THE INVENTION

The present invention comprises an improved closure or cap and an improved neck finish. The cap skirt and neck are provided with mating threads of such shape that the cap may be applied in a simple downward vertical movement, the cap skirt and neck flexing sufficiently to permit the threads to slip past each other.

The threads may be continuous or interrupted. Also, instead of there being two threads—one on the neck and one on the cap, one external thread may be replaced with a groove. The term "helical engagement means" is sometimes used herein to encompass all such screw retention means.

The cap has a tamper-evident tear band below the skirt which is connected to the skirt by a plurality of bridges or by a continuous line of weakness. Ratchet teeth are positioned on the inside of the tamper evident band. Correspondingly, the container neck below the threads is formed with external ratchet teeth. The mating ratchet teeth of the cap and container neck are engaged by the initial downward movement of the cap relative to the neck. In other words, in order to engage the ratchet teeth it is not necessary to rotate the cap relative to the neck, thereby differing from conventional threaded tamper-evident caps. It is merely necessary to provide alignment means on the cap and on the container so that the cap is initially properly oriented in such position that a direct single vertically downward movement of the cap relative to the neck causes the threads to slip relative to each other and the ratchet teeth to lock in final position. Chamfers on the ratchet structure of either closure or container can be used as a "fine" orientation system as the closure is initially applied.

To achieve proper registration of threads when a simple direct axial application force is used, both the neck threads and closure threads must be oriented. Orientation of the container is relatively easy. Generally, containers are either non-circular or have non-circular features which may be used for proper orientation. In accordance with a preferred form of the invention shown herein, the closure has a downward projecting tab similar to the tear tab used on push-on tear-off closures. The vertical tear tab characteristic of the present closure is an excellent orientation feature. However, other means for orienting the cap and container may be used.

Thread design is another feature of the invention. A large number of threads per inch of axial height is desirable for two reasons. First, a fine thread may be used and such a thread does not have to be as deep as a coarse thread, and hence the forces required for threads to jump during application are minimized. Secondly, fine threads minimize the height required to achieve a standard design criterion of 360° or more of thread engagement which permits a lighter closure weight.

The greater the number of thread leads, the less actual turning action is required to remove or reapply the cap. In addition, multiple thread leads promote more "squareness" during straight axial application. In other words, the cap seats horizontally on the neck because the termini of the threads are statically balanced. However, additional leads require a higher thread pitch assuming constant threads per inch and excessively high thread pitch results in a situation where the closure may back off or unscrew itself from sealed position.

In accordance with the present invention, a preferred thread for a blow-molded, high density polyethylene bottle is 12 threads per inch and two leads. If bottle finish processing permits, it would be advantageous to design for higher threads per inch and more leads. For example, if the bottle is made with injection blow mold equipment, a very fine bottle thread is possible. In that case, it might be preferable to use, for example, a 16 thread-per-inch, 4 lead, 4 pitch thread. The more leads, the more squarely the cap sets on the neck and the more effectively the closure will be seated by a direct downward, axial application force.

Also, consumer advantages of quick release and reapplication can be achieved with multiple lead threads.

In order to provide a tamper-evident feature, the closure should not be removable without some apparent closure characteristic changing. Generally, this requirement is satisfied by incorporating a frangible section which is destroyed during initial closure removal. One type of frangible section is a continuous thinned tear line, but in a cap of the present invention, such a system may not be the best choice, although permissible and is disclosed as a modification of the first embodiment of the invention. A preferred tamper-evident feature provides a frangible section having a number of frangible connections or bridges between the closure skirt and a tamper-evident ring below the bottom edge of the skirt. The preferred approach is to incorporate enough bridges around the circumference such that the combined strength of the bridges prevents unscrewing. The tamper evident band must be removed to allow unscrewing. Sequential breaking of the many bridges around the circumference simulates a continuous tear. A second approach is to incorporate only a few bridges around the circumference of the skirt such that the combined strength of the bridges is not sufficient to prevent unscrewing and the bridges rupture as the cap is initially unscrewed. With this second approach the broken bridges give evidence of opening. A major advantage of using bridges rather than a continuous tear strip is that a wide range of material choices is possible. Therefore a multiple bridge simulated tear structure is generally preferred over continuous tear frangible sections and this approach is used in the preferred embodiments of the present invention. However, in a modification of the invention an uninterrupted horizontal shoulder between the upper and lower portions of the cap is used, which shoulder is formed with a line of weakness. The alternative modification eliminates the space between the bridges to create a continuous frangible line. This modification is used successfully only when the cap is formed of a low density polyethylene and is not successfully used with higher density plastic materials. One of the advantages of the elimination of the spaced bridges is that of cleanliness in that the continuous shoulder prevents dirt and liquids from contacting any portion of the neck surface above the bottom edge of the cap.

In a preferred embodiment of the invention hereinafter described in detail, the closure is first oriented by means of its tear tab and the containers are likewise oriented. The closure and bottle are snapped together and the orientation allows registration of both the threads and the ratchets which hold the cap in place until the tamper-evident band is removed. Seal of the container may be made with a liner, foil or a linerless feature such as a plug or flap. Before initial removal, the multiple bridges are collectively sufficiently strong to prevent unscrewing and also resist any tendency of the closure to back off the neck. During initial removal, in the preferred embodiment the tear band is removed through sequential breaking of the bridges, thereby simulating a continuous tear strip but allowing the use of such plastic materials as polypropylene and high density polyethylene. Once the tear band is removed, the system functions as with normal threaded closures. Alternatively the upper and lower portions of the cap skirt are connected by a reduced number of angularly spaced bridges. Merely by twisting the upper skirt portion the bridges may be severed, giving evidence of tampering, and making it possible to unscrew the cap.

One of the features of the present invention is that the lower skirt portion, which includes tamper-evident features and, more particularly, contains ratchet teeth mating with corresponding teeth on the container neck, is formed with a vertical line of weakness and a tear tab adjacent thereto. When the lower skirt is removed it tears along the vertical line of weakness as well as along the line of weakness between the upper part of the cap and the lower skirt (i.e., tamper-evident band.) This feature has a number of advantages:

First, it prevents defeating the tamper-evident feature. Were it not for the vertical line of weakness, a dishonest patron might unscrew the upper cap, remove the contents of the container and replace the cap. It is somewhat difficult to observe that the line of weakness between the upper cap and tamper-evident band has been severed. When the vertical line of weakness is severed, this is not a problem since the lower skirt cannot be replaced.

Second, if the molds for the cap are not perfectly supported, plastic material may fill some or all of the voids between bridges joining the upper cap to the tamper-evident band. This makes it difficult for some users to remove the tamper-evident band. The vertical line of weakness makes it much easier to remove the lower skirt or band. Indeed, the bridges between the upper cap and band may be made thicker or some of the voids between bridges may be eliminated.

Thirdly, the intact tamper-evident band may create a danger to wildlife if the head of a bird, fish or small animal is entrapped therein. Splitting the band along the vertical line of weakness eliminates this hazard.

A further feature of the invention is the fact that the cap ratchet lug on the interior of the lower cap skirt is located between two external lugs on the neck finish when the cap is applied so that on application the cap cannot rotate outside of its "tolerance range", that is, there is an orientation feature of the cap and bottle ratchets for proper engagement.

Another advantage of the invention is that the cap may be applied to the neck in two stages (i.e., "double click"). When the container is filled with milk or certain other liquids, entrapped air or other gases tend to cause foam. The thread structure of the present invention makes it possible to press the cap down until one set of threads passes the other. This holds the cap on the neck and holds it properly aligned relative to the neck ratchet. However, the cap is not tight and hence air and gas may escape. Then the cap is pressed down once more to tightly engaged and sealed position. To insure two "clicks" the closure thread has to jump two neck threads during application. This means that if the cap threads extend a full 360° around the cap skirt inner wall (180° each for double lead threads), the finish threads have to be repetitive at some point of the circumference. This also means that either the cap threads or the finish thread must be repetitive vertically. I.e., the threads must overlap on either the neck or cap in order to make possible the double click.

More specifically, the caps pass down a conveyor overlying the path of the containers and as each container passes the end of the conveyor, a cap drops onto the neck. The cap and neck then pass under a roller which preliminarily presses the cap down on the neck. One of the features of the thread construction of the present invention is that there is more than one full turn of thread engagement of the threads. Hence, the roller pushing the cap through the first step or snap prevents the latter from falling off the neck when it is subjected to such action as milk foaming in the interior of the container. Hence the cap stays on the bottle, although not being tightly sealed thereto, until the bottle passes under the conventional capping machine belt or pressure plate which fully seats the cap on the neck. This is a second step or snap of the cap on the bottle and insures that both threads are tightly engaged.

When the first snap of the cap on the bottle occurs, the ratchet teeth of the cap engage the ratchet teeth of the neck but a slight twisting is possible within the range of tolerance of approximately 20°. Such a rotation of the cap relative to the neck changes the height of the cap only about 0.009 inches. However, this turning ability of the cap relative to the neck with such slight changes in the height of the cap relative to the neck insures proper final alignment of the ratchet teeth of the cap and neck, while permitting release of foam or excess air.

Still another feature of the invention is an internal shoulder at the intersection of the underside of the disk and the top of the upper cap skirt. This shoulder prevents the cap from being turned or torqued to jump threads or strip the threads. The inner plug of the cap tends to push the neck of the bottle outward against the shoulder and the shoulder then prevents turning or stripping. Further, the fit of the shoulder against the neck tends to reduce leakage and rigidifies the cap.

Another feature of the present invention is that the cap is provided with a plug or inner skirt which fits inside the bottle neck. The length of this plug is related to the positioning of the screw threads on the cap in such manner that the threads of the cap and bottle neck engage before the plug engages the neck. Thus a quarter-turn of each of the double lead threads occurs before the plug contacts the neck. This feature reduces the possibility of cross-threading when the cap is applied to the neck as a reclosure cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 7:
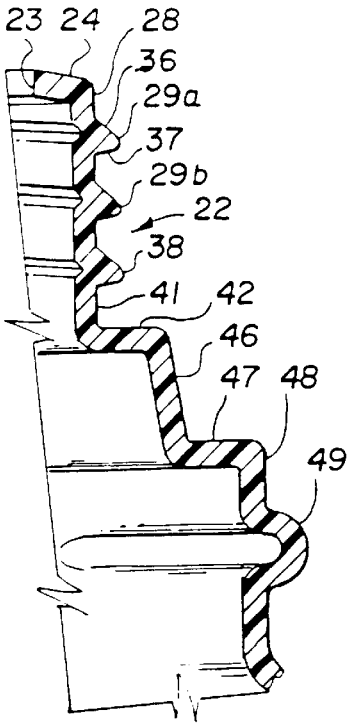
FIGS. 7 and 8 are, respectively, enlarged fragmentary sectional views taken along lines 7—7 and 8—8 of FIG. 6.
Figure 8:
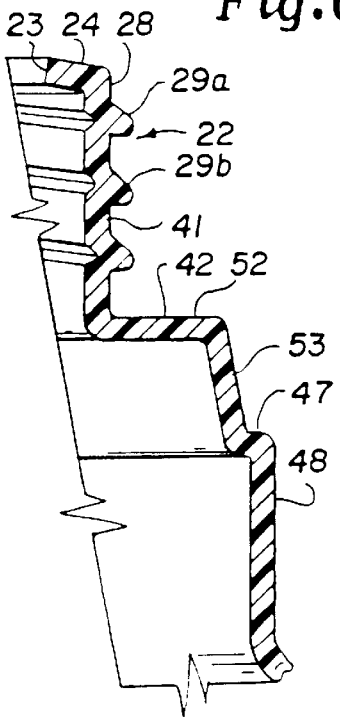

Cap 21, hereinafter described in detail, is used with a container neck 22. Neck 22 has a central neck opening 23 and extending outwardly thereof a downward-outward slanted lip flange 24 which terminates in a vertical stretch 28. The exterior of neck 22 is hereinafter described. The interior thereof forms no part of the present invention. With a blow-molded bottle finish as illustrated in FIGS. 7 and 8, the interior contour of the neck generally tends to follow that of the exterior. However, it will be understood that other types of bottles may be used and in such instances the internal neck shape may vary from that of the exterior.

Extending outward of stretch 28 are threads 29. In the depicted embodiment of FIGS. 7 and 8 there are two threads 29 designated 29*a* and 29*b*. In the embodiment, the finish has twelve threads per inch with a double lead, each thread being six pitch and extending slightly in excess of 360° of a full thread. Thus the upper terminus 31 of the first thread is vertically displaced approximately 0.166 inch from the lower terminus 32 thereof. The upper terminus 33 of the second thread is displaced 180° relative to terminus 31 and its lower terminus 34 is approximately diametrically opposite terminus 32. It is understood that the threads can be extended greater than 360° to achieve increased thread engagement. Also, additional thread leads and different linear thread density (threads per inch) are permitted and may be advantageously chosen. In order to permit the threads of the cap to slip past the threads of the neck, as shown in FIG. 7, the upper flank 36 of thread 29 slants downwardly and outwardly at approximately 45° while the lower flank 37 slants downwardly and inwardly at an angle of about 10°. Preferably the thread apex 38 is made with as large a radius as possible. A portion 41 of vertical stretch 28 is located below the threads 29 extending down to upper shoulder 42, which is horizontal.

As stated previously, instead of threads on the inside of the skirt and outside of the neck, one thread may be replaced by a groove. Further, instead of threads 29 being continuous, they may be interrupted.

Below shoulder 42 is locking area wall 46 which slants downward/outward at an angle of about 10°. Wall 6 terminates in lower shoulder 47 which is also approximately horizontal. Outwardly of and below shoulder 47 is a lower vertical stretch 48 which at its lower end merges with the container. Bumper ring segments 49 (here shown as four in number) may be formed in the stretch 48 to facilitate gripping the container during filling and loading and also to provide certain vertical flexibility to the neck during the capping operation.

Figure 6:
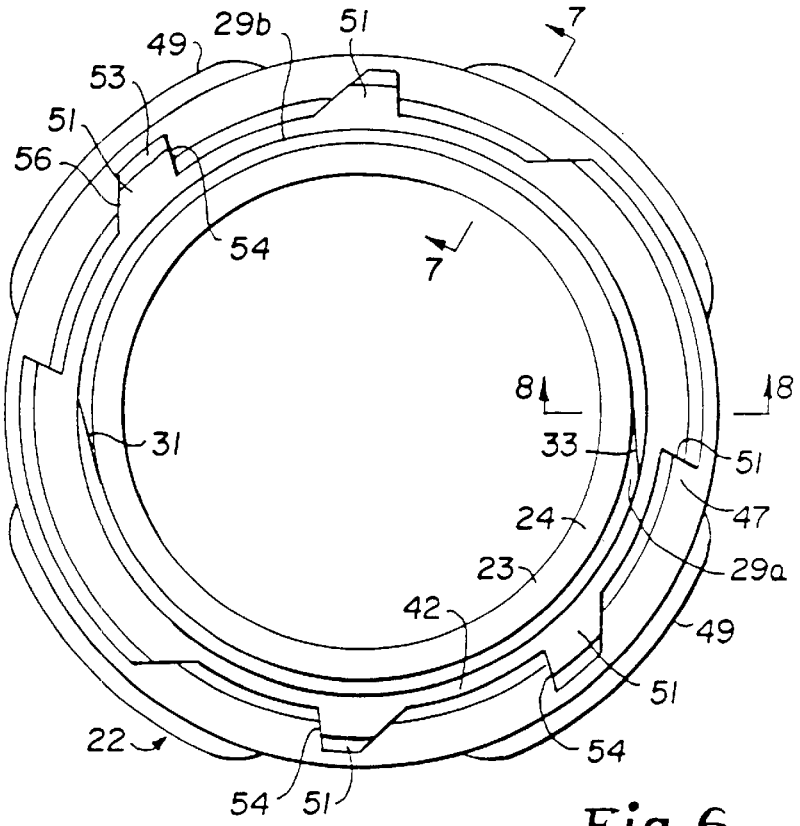
FIG. 6 is a top plan of the neck.

On opposite sides of neck 22 projecting out from wall 46 are teeth 51. As illustrated in FIG. 6, there are typically three such teeth on one side of the container neck and three teeth on the opposite side. The total extent of the three teeth on each side is approximately 90°. Each tooth has a top surface 52 which can be co-planar with the surface of shoulder 42. Outer surface 53 slants downward/outward at an angle of approximately 10°, terminating in shoulder 47. The front edges 54 viewed from above in plan as in FIG. 6 (assuming a right-hand thread) are disposed at varying angles from about 45° to about 0° relative to a radial line drawn perpendicular to the vertical axis and are approximately vertical.

A preferred cap 21 used with the neck structure 22 previously described is illustrated in FIGS. 1 to 5. The cap has a generally flat top disk 61 from the periphery of which depends substantially vertical short upper skirt 62. The lower edge of skirt 62 merges with slanted stretch 63, which, in turn, merges with vertical stretch 64. An internal shoulder 65 is formed at the intersection of stretches 62 and 63. Members 62, 63, 64 have vertical ribs 66 spaced therearound to enable the user to grip the cap. Chamfers 67 are preferably formed on the upper edges of ribs 66. The ribs of the cap are thus, in effect, rounded but extend higher. Hence they are more severely gripped by the user when screwing or unscrewing the cap.

On the interior of skirt 66 are formed threads 71*a* and 71*b* which are selected to mate with threads 29*a* and 29*b* of neck 22. The bottom edge 72 of skirt 64 is connected to shoulder 73 and generally downwardly/outwardly slanted lower skirt 74 by a plurality of bridges 76 which in fact constitute the lower edges of ribs 66. The bridges and voids therebetween are sometimes referred to herein as "horizontal lines of weakness". Skirt 74 has a generally horizontal lower edge 77.

Teeth 81 spaced and dimensioned to match the teeth 51 of neck 22 are formed on the inside of wall 74. The inner edges 82 of the teeth are positioned close to inner surface 46 after cap application. The leading edge 83 of each tooth 81 is formed at an angle of approximately 45° to a radial line, thereby ensuring good interlock with the complementary surface 54 of neck 22. This angular relationship biases the cap 21 into a more secure locking arrangement with the neck 22.

Tear tab 86 extends downwardly from lower edge 77 and an upper side edge thereof merges with a weakened vertically extending line 87 formed in skirt 74. Use of weakened line 87 is optional, but preferably used to prevent the ring-like skirt 74 being a hazard to wildlife and to accomplish the other objects set forth earlier in this description. When the consumer grips tab 86, bridges 76 are severed and the vertical weakened line 87 is broken. Thus pulling the tab 86 sequentially fractures weakened line 87 and then each of the bridges 76 (i.e., the horizontal weakened line). Removal of the lower skirt 74 removes the ratchet teeth 81 and hence frees the upper portion of the cap so that it can be unscrewed. However, such removal of the lower skirt gives evidence of the opening of the cap and hence is a tamper-evident feature. Alternatively, the user may twist upper skirt 64, severing bridges 76. To prevent defeating the tamper-evident features of the cap, the bridges may be made stronger. A combination of circumferentially spaced thin bridges 76 and arcuate continuous areas relieved by circular arc tear lines may be used.

Although various liners may be used to secure the under side of disk 61 to the lip flange 24 of neck 22, in the accompanying drawings, a preferred embodiment shows an inner skirt or plug 91 extending downward from top disk 61 and fitting inside the neck opening 23. Preferably the outer bottom edge of skirt 91 is formed with a bevel 92 to facilitate seating of the cap 21 on the neck 22. A circular rib 94 on the underside of disk 61 is located between plug 91 and skirt 62 and engages neck lip flange 24 to provide a secondary seal.

The threads 71*a*, 71*b* of cap 21 are double lead and each extends around the circumference of the cap in excess of 180°, i.e., approximately 200°. The threads 71*a*, 71*b* originate very close to the bottom edge 72 of vertical stretch 64. Threads 29*a* and 29*b* of the neck 22 originate spaced somewhat downwardly from the top on vertical stretch 28. As has previously been stated in the summary of this invention, in conventional capping machines, cap 21 is deposited on neck 22. Because of the fact that the threads 71*b* and 71*a* are diametrically opposed, the cap 21 tends to rest on the neck 22 approximately horizontally. The first step in seating cap 21 is to pass under a roller which pushes the cap 21 downwardly. The threads on the cap slip over the uppermost threads on the neck 22 during this first step which may be termed a "first snap". At this point the cap is not fully seated, still resting at least one bottle thread above its fully seated and applied position. If the container has been filled with a substance such as milk which tends to foam, the first snap action permits some of the air in the container to escape since the cap is not completely sealed on the neck. Thereafter, the cap and container pass under a seating belt or pressure plate which forces the cap 21 downward until it is completely seated on the neck 22, thereby completing the second snap or step. To achieve this advantageous "double snap application" the relative axial movement of cap and bottle neck to a fully sealed and seated position must involve a portion of the cap threads jumping at least two neck threads or vice versa.

The first step in the seating of the cap on the neck (first snap) brings the teeth 81 of the cap into partial engagement with the teeth 51 of the neck, but within about a 20° tolerance. This permits the aforementioned foaming without allowing cap rotation away from proper orientation. The second step of the seating causes the teeth 81 and 51 to fully interengage.

Figure 9:
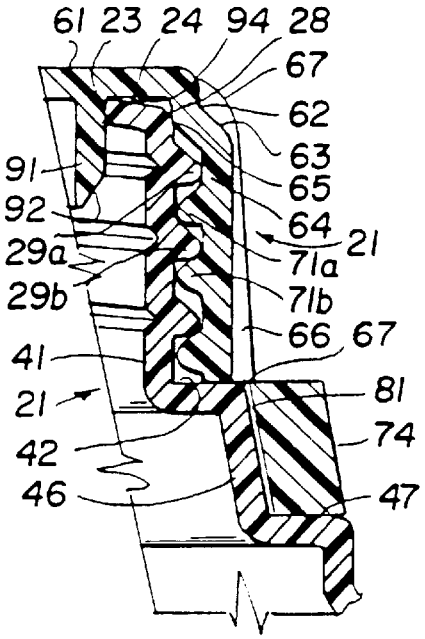
FIG. 9 is an enlarged, fragmentary sectional view through an assembled cap and neck taken in the positions of line 4—4 of FIG. 2 and 7—7 of FIG. 6.

Another feature of the invention best shown in FIG. 9 is the function of the shoulder 65 of cap 21. The inner plug 91 tends to push the lip 24 outwardly. Hence the shoulder 65 tightly engages the surface 28 and promotes effective sealing.

Figure 10:
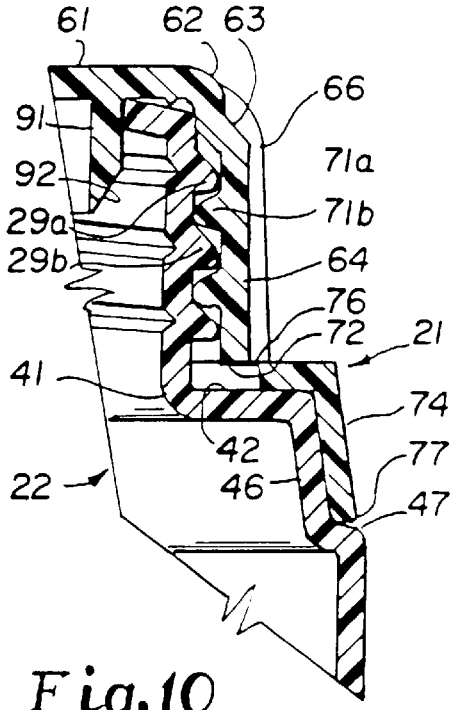
FIG. 10 is a view similar to FIG. 9 taken in the positions of line 5—5 of FIG. 2 and 8—8 of FIG. 6.
Figure 10A:
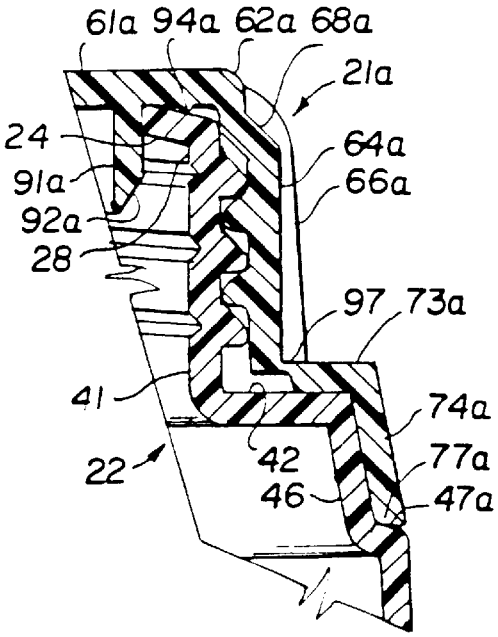
FIG. 10A is a view similar to FIG. 10 of a modification.

Directing attention now to FIG. 10A, instead of bridges 76 being formed connecting the shoulder 73*a* to the lower end of vertical stretch 64*a*, the shoulder 73*a* is continued inward but the material is very thin. In other words, a horizontal line of weakness 97 replaces the bridges 76 but the line of weakness is continuous. Hence the lower skirt 74*a* may be removed by tearing away the line of weakness 97.

The use of the modification of FIG. 10A is particularly suited when the cap is made of a material such as low density polyethylene. An advantage of having a line of weakness rather than separated bridges is that dirt and water cannot enter in the voids between the bridges and collect between the cap and neck.

In other respects the modification of FIG. 10A resembles that of the preceding modification and the same reference numeral followed by the subscript a is used to designate corresponding elements.

Preferred Operation I

After the container has been filled, it is transported through a capping machine. As is well understood in the bottling art, and in a manner similar to that whereby push-on, pull-off caps are applied, the caps 21 are fed one at a time out of a bowl in the capping machine along a conveyor, the tear tabs 86 orienting the caps so that they are all discharged in a pre-determined orientation relative to the containers which pass therebelow. Although not shown in the accompanying drawings, each container has a square cross-section or some other variation from a round shape which permits the container neck 22 to be oriented relative to the cap 21. The structure of capping machines is well known in the bottling art. Because of the relative orientation of the cap 21 and container neck 22, the teeth 81 of the cap are in vertical alignment with the gaps between teeth 51 of neck 22. An axially downward force is applied to cap 21 causing it to move down. As it moves down, the inner skirt 91 fits inside neck opening 23. The threads 71*a* and 71*b* slip over the threads 29*a* and 29*b*, the slanted surfaces 36 facilitating such movement. As has been stated, the sealing is preferably in two steps or snap actions. The cap 21 is sufficiently resilient so that it expands outward sufficiently to permit the threads to slip. As the cap 21 seats on the neck 22, the teeth 81 engage between the teeth 51 to fully seat the teeth 81 in place. Flange 24 then engages the under side of disk 61 and the outer wall of inner skirt 91, sealing the container. The engagement of threads 71 and 29 retain the cap tightly to the neck.

Figure 11A:
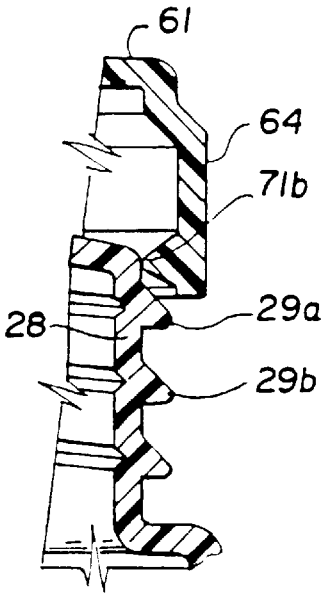
FIGS. 11A, 11B and 11C are schematic views showing progressive "double click" cap attachment wherein the cap thread has one turn and the neck has multiple threads.
Figure 11B:
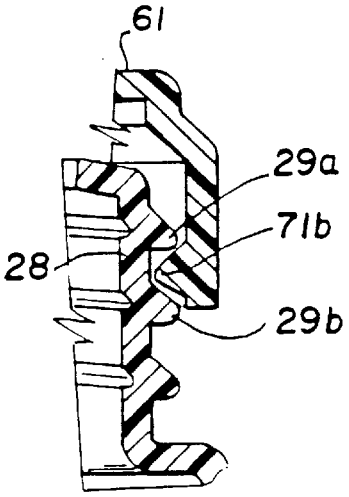
Figure 11C:
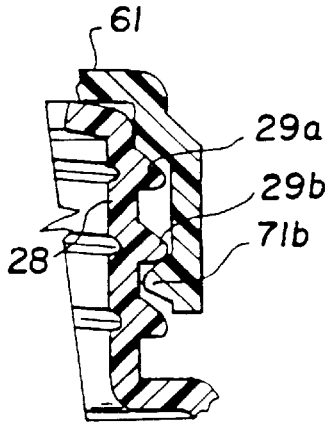

FIGS. 11A, 11B and 11C illustrate schematically the two-step seating heretofore described. In FIG. 11A the single turn cap thread 71*b* rests on the top of the uppermost neck thread. In FIG. 11B the thread 71*b* of the cap has been pushed over neck thread 29*a* but the cap is not fully seated. Hence gases may escape from the container. In FIG. 11C the second click occurs, when thread 71*b* seats under thread 29*b*.

Figure 12A:
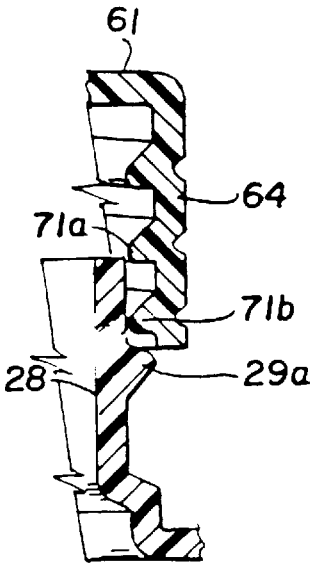
FIGS. 12A, 12B and 12C are views similar to FIGS. 11A, 11B and 11C wherein the neck thread has one turn and the cap thread multiple turns.
Figure 12B:
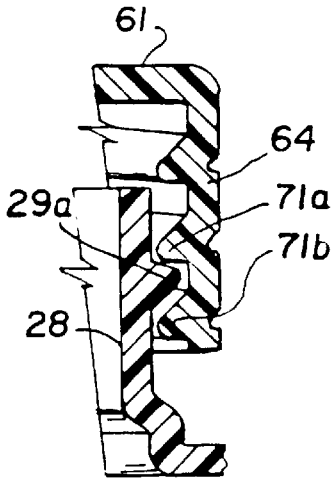
Figure 12C:
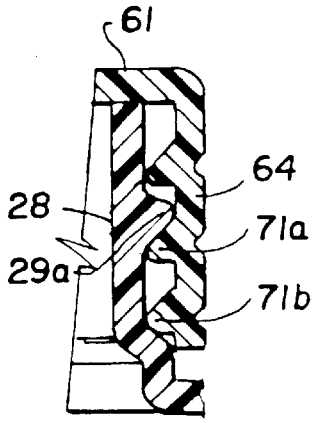
Figure 13:
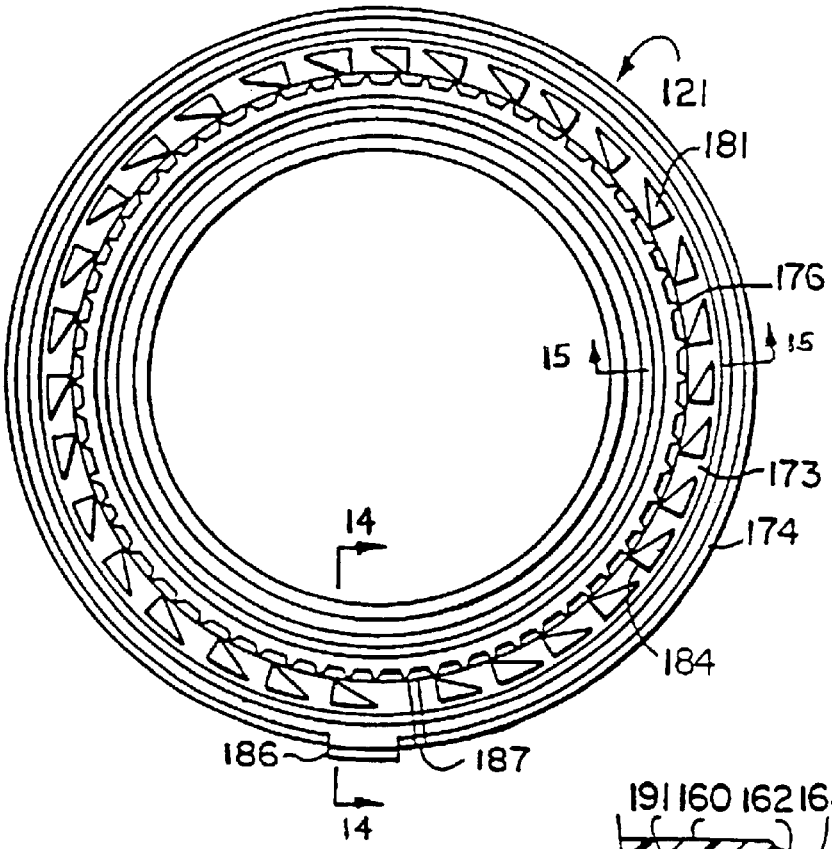
FIG. 13 is a bottom plan view of a cap.
Figure 14:
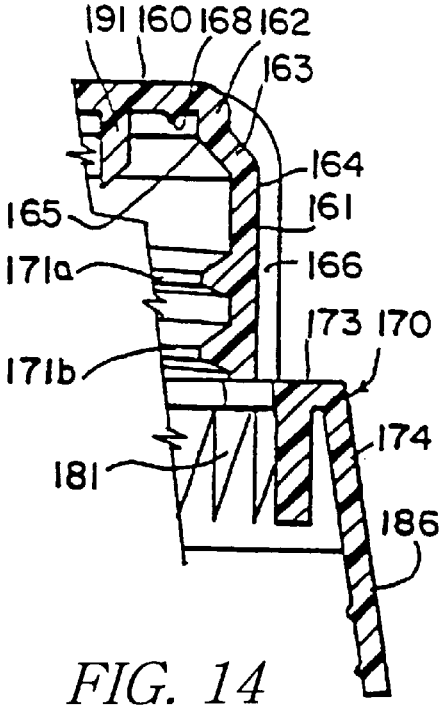
FIG. 14 is an enlarged, fragmentary sectional view of a cap taken along line 14—14 of FIG. 13.
Figure 15:
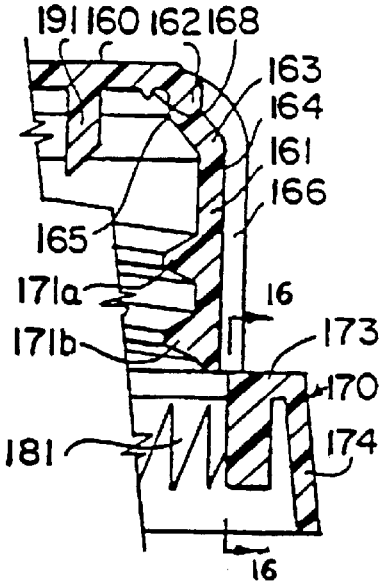
FIG. 15 is an enlarged, fragmentary sectional view of a cap taken along line 15—15 of FIG. 13.
Figure 16:
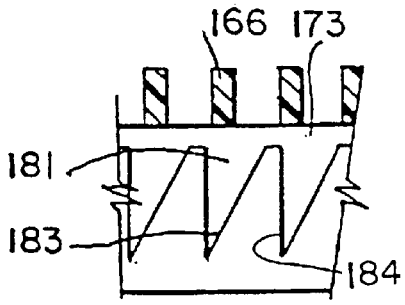
FIG. 16 is an enlarged, fragmentary sectional view taken along line 16—16 of FIG. 15.

FIG. 12A shows a reverse situation wherein thread 29*a* on the neck rests under the cap thread 71*b*. In FIG. 12B the first click has occurred and thread 29*a* is between threads 71*a* and 71*b*. FIG. 12C shows completion of seating wherein thread 29*a* is above threads 71*a* and 71*b*.

After the cap 21 has been fully seated on neck 22 it cannot be removed without giving evidence of tampering. Thus the interengagement of teeth 81 and 51 prevent unscrewing the cap and the interengagement of threads 71 with threads 29 prevents lifting the cap off the neck.

When it is desired to open the container, the user grips the tab 86 and breaks line 87, then pulls circumferentially around the container causing the lower skirt 74 to be removed, thereby removing the teeth 81. This gives evidence of tampering. However, it also permits the user to grip the ribs 66 and unscrew the cap 21 from neck 22.

Figure 1:
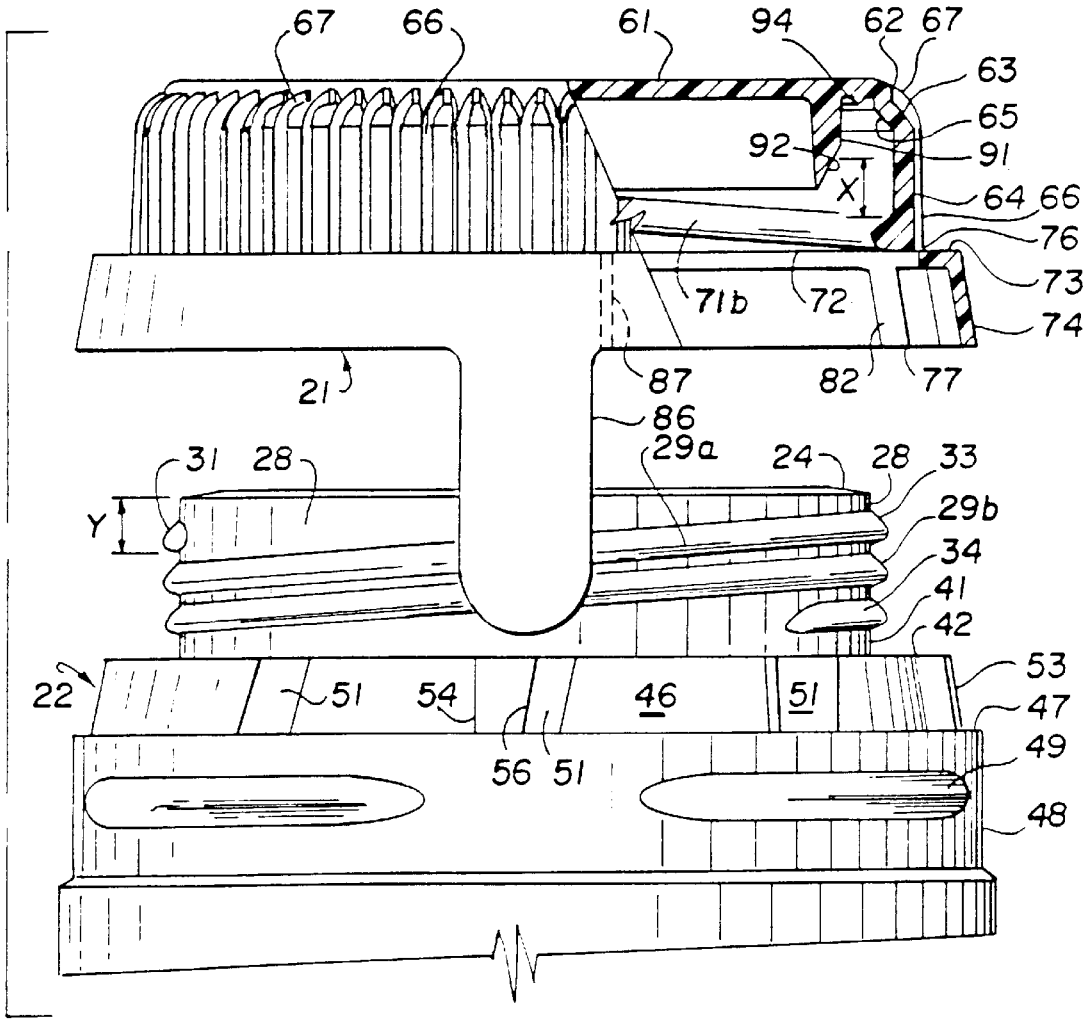
FIG. 1 is a side elevational view of a cap and neck before assembly, the cap being partially broken away in section to reveal internal construction.
Figure 2:
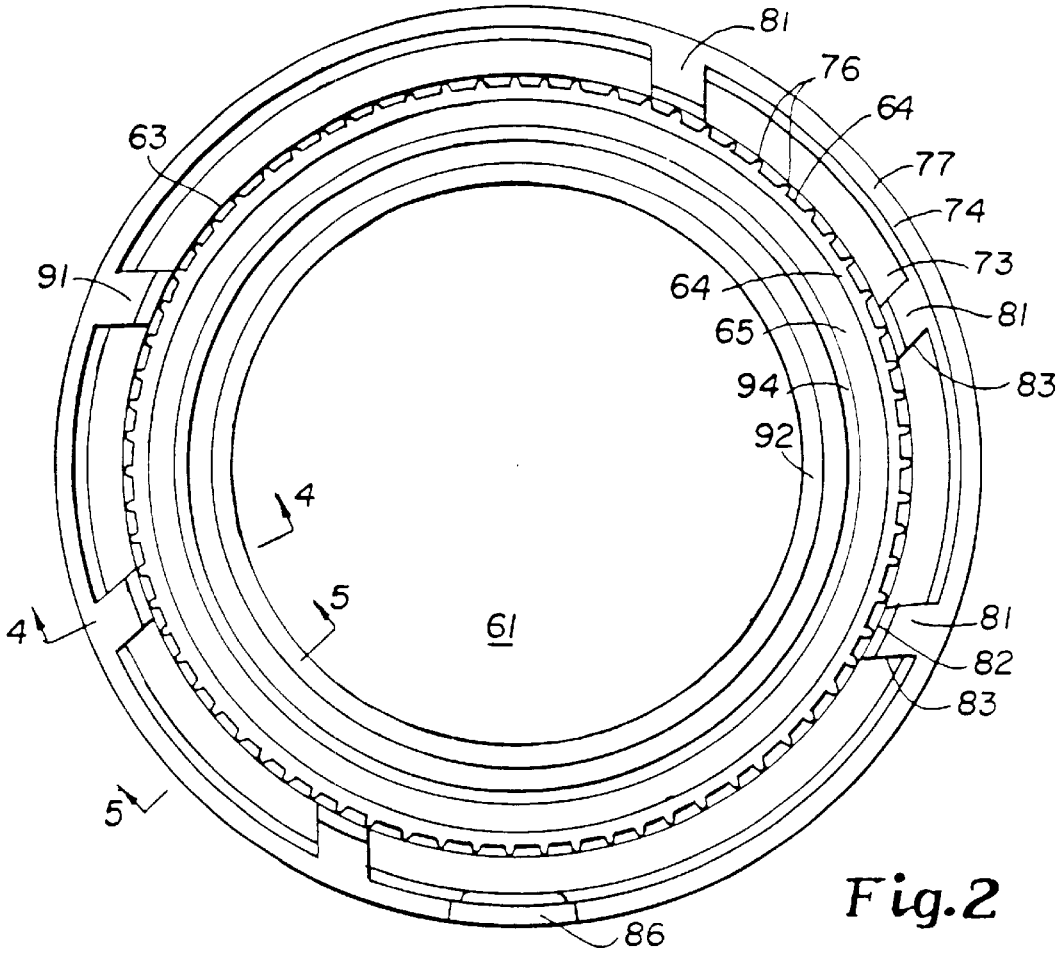
FIG. 2 is a bottom plan of the cap.
Figure 3:
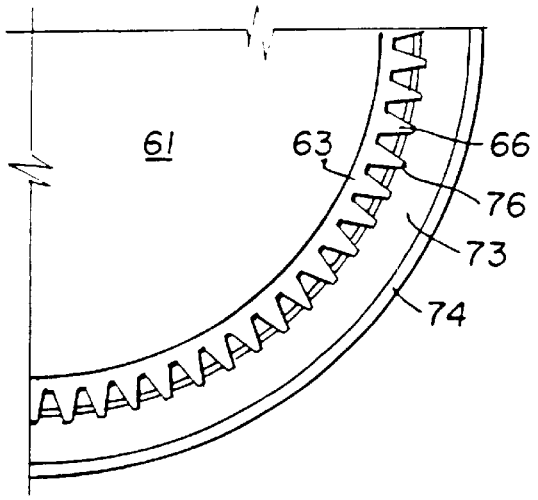
FIG. 3 is a fragmentary enlarged top plan of the cap.
Figure 4:
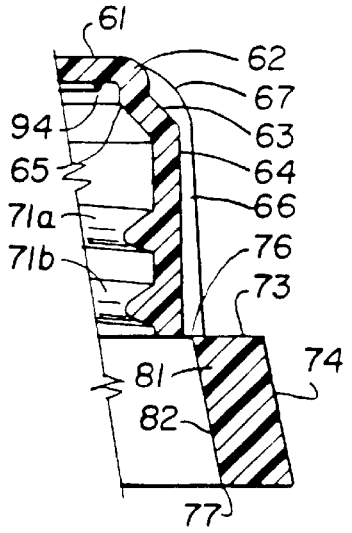
FIGS. 4 and 5 are, respectively, enlarged, fragmentary sectional views taken along lines 4—4 and 5—5 of FIG. 2.
Figure 5:
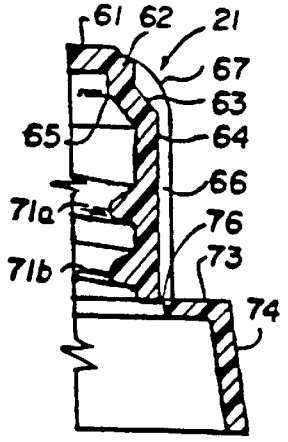

To replace the cap, it is merely necessary to reverse the direction of turning. Directing attention now to the structure shown in FIG. 1, another feature of the relationship between the plug 91 and threads 71*a*, 71*b* is shown. It is desirable that when the portion of the cap 21 above the lower skirt 74 is used as a reclosure cap, that proper seating of the reclosure cap be insured so that the reclosed bottle does not leak. In FIG. 1 the reference letter X is used to designate the vertical distance between the upper edge of threads 71*a* and 71*b* and the point at which the flange 24 of neck 22 contacts the slanted surface 92 of plug 91. The reference letter Y is used to designate the minimum vertical dimension between the top edge of vertical stretch 28 of neck 22 and the underside of the thread start 31. A feature of the structure is that at some position of the cap the dimension X be greater than the dimension Y. Hence when the reclosure cap is placed on the container neck, the threads interengage, preferably a quarter-turn or more before the upper edge of the container neck engages the inner skirt or plug. This prevents cross-threading or stripping of the threads when the reclosure cap is tightened on the neck.

As used in the claims, the term "thread" is used not only to include external threads but internal ones as well and to include continuous and interrupted threads or other "helical engagement means". In the specification and claims, the cumulative turn total for multi-lead threads or other such helical engagement means is the sum total of the number of turns of the individual multi-lead threads around either the neck stretch portion or the upper skirt portion. For multi-lead threads, "in excess of one turn total" means that the sum total of the number of turns of the individual threads is in excess of 360°. The language "at least one vertically extending arc stretch" refers to a portion of the upper skirt or neck stretch where the threads overlap or are repetitive vertically, whereby a vertical line drawn within the arc stretch will intersect at least two threads. When the threads on either the cap or the neck overlap (i.e. a vertical line drawn within the arc stretch will traverse the helical engagement means at least two times), the application of the cap onto the container with at least two "clicks" is ensured.

Closure 121, hereinafter described in detail, is used with a container neck 122. The interior of the neck forms no part of the present invention. With a blow-molded bottle finish, the interior contour tends to follow that of the neck exterior. However, it will be understood that other types of bottles may be used, with the internal shape of the neck varying from that of the exterior.

Neck 122 has a central opening 123 and a downward-outward slanted lip flange 124 terminating in an upper neck stretch 128. Threads 129 extend outward of stretch 128. In the illustrated embodiment, there are two threads 129*a* and 129*b*. The finish has twelve threads per inch with a double lead, each thread being six pitch and extending slightly in excess of 360° of a full thread. It is to be understood that the threads may be extended greater than 360° for increased thread engagement. Additionally, the thread leads may be of a different linear thread density (threads per inch). The upper flank 136 of thread 129 slants downwardly/outwardly at approximately 45° while the lower flank 137 slants downwardly/inwardly at approximately 10°, permitting the threads on the interior of the cap to slip past the threads on the neck finish. Preferably, the thread apex 138 is made with as large a radius as possible, but being sufficient to insure that the cap must be unscrewed and not pulled from the neck.

Instead of cooperatively shaped threads on the upper neck stretch and the inner surface of the closure, one thread may be replaced by a groove. Further, threads 129 may be interrupted, instead of being continuous.

The container neck includes a tamper-evidencing portion 40 below the upper neck stretch 128 which includes an outward extending shoulder 142, a locking wall 146 offset outwardly relative to the upper neck stretch 128, and a lower outward extending shoulder 147. A plurality of upward projecting teeth 151 are formed on the tamper-evidencing portion of the neck. A vertical stretch 148 depends from shoulder 147. To facilitate gripping the container during filling and loading, vertical stretch 148 may be formed with a number of bumper ring segments 149 (here shown as four in number).

Figure 18:
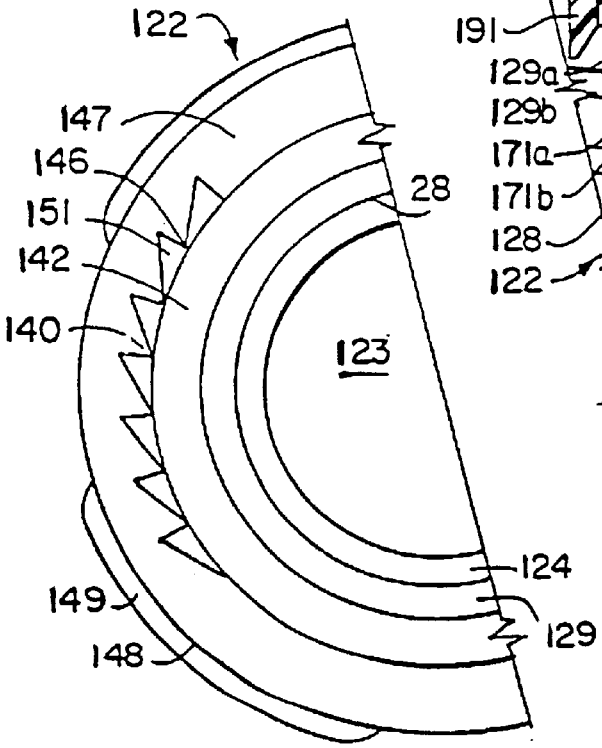
FIG. 18 is a fragmentary, top plan view of a container.

The teeth 151 extend upwardly from the shoulder stretch 147. The teeth are shaped and positioned to cooperate with internal teeth formed on the closure, the interengagement between the teeth resisting unscrewing of the cap from the neck. Typically, multiple teeth 151 (FIG. 18) are formed on either side of neck 122, with the total extent of the multiple teeth being approximately 90°.

A cap for use with neck structure 122 is illustrated in FIGS. 13 to 17. The cap has a top 160 from the periphery of which depends downward extending upper skirt 161. As illustrated, the top comprises a generally flat top disk; however, other configurations may be substituted. The upper skirt 161 is formed with a generally vertical upper edge 162 which merges with outward-downward slanted stretch 163, which in turn merges with vertical stretch 164. An internal shoulder 165 is formed at the intersection of stretches 162 and 163. A sealing bead 168 depends from the underside of top 160. When the cap 121 seats on the neck, bead 168 engages lip flange 124, internal shoulder 165 engages the upper edge of vertical stretch 128 and inner skirt or plug 191 engages lip flange 124, substantially sealing the container. Members 162, 163 and 164 have radially spaced vertical ribs 166 to enable the user to grip the cap.

Figure 17:
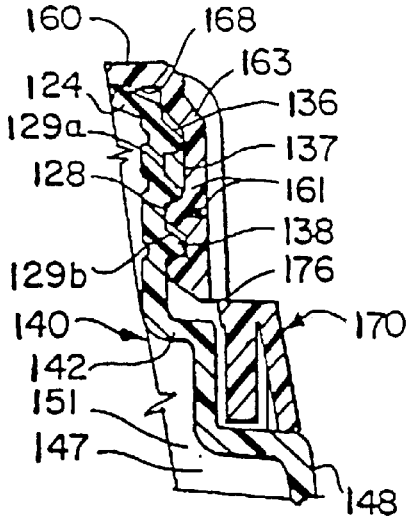
FIG. 17 is an enlarged, fragmentary sectional view of a cap applied to a neck.
Figure 17A:
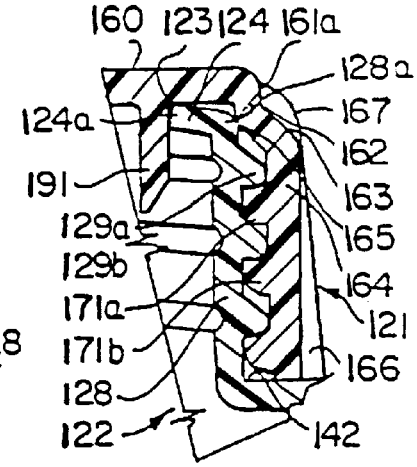
FIG. 17A is an enlarged, fragmentary sectional view of a cap applied to a neck.

As is shown in FIG. 17A, the internal shoulder 165 provides an inward projecting portion 161*a* of the upper skirt 161 which cooperates with the exterior of the neck stretch 128. Since the circumference of the upper portion 128*a* of neck stretch 128 is greater than the interior circumference of the cap 121 at the inward projecting portion 161*a* of the skirt, a tight fit is formed between the inward projecting portion and the neck stretch exterior. The tight fit between the upper skirt portion above thread 171*a* and the exterior of the neck stretch 128 above thread 129*a* promotes an effective seal between the exterior of the plug 191 and the interior edge 124*a* of the lip 124. When the cap 121 is applied to the neck 122, the upper skirt 161 is biased outward as the inward projecting portion 161*a* engages the exterior of the neck stretch 128. Since the closure is resilient, the inner plug 191 of the cap is urged toward the lip 124 to form a seal between the generally seamless interior edge 124*a* of the lip and exterior of the plug 191. In other words, the inward projecting portion provides a means for biasing the upper skirt and the plug outward to urge the plug into sealing engagement with the lip 124. The fit of the shoulder against the neck tends to reduce leakage and rigidify the cap, preventing the cap from being turned or torqued to jump threads or strip the threads. The inner plug 191 of the cap 121 tends to push the neck of the bottle outward against the shoulder and the shoulder then prevents turning or stripping.

Threads 171*a* and 171*b*, which are selected to mate with threads 129 of neck 122, are formed on the interior of the skirt. The shape of threads 129*a*, 129*b*, 171*a*, and 171*b* allow the threads to slip past one another and then interengage. In the presently described embodiment, threads 171*a* and 171*b* are double lead and each extend around the circumference of the cap in excess of 180°, for example, approximately 200°. In conventional capping machines, cap 121 is deposited on neck 122. Since threads 171*a*, 171*b* are diametrically opposed, the cap tends to rest horizontally on neck 122, facilitating the application of the cap onto the neck with a downward, axial force.

In order for the closure and container threads to effectively slip past each other during direct axial application it is necessary that the threads be finer than would be appropriate for a threaded closure applied by conventional rotary application. As threads become finer, a greater amount of total thread engagement is often necessary to prevent excessive forward stripping on reapplication. For the present embodiment, which includes a linear density of twelve threads per inch and is formed with double leads, a thread engagement of approximately 200° for each of the two cap threads is satisfactory (i.e. 400° of total thread engagement).

Finer threads such as sixteen or twenty threads per inch would require greater total thread engagement.

The closure includes a tamper-evidencing band 170 below the upper skirt portion 161 provided with a plurality of internal ratchet teeth 181. In the present embodiment, the tamper-evidencing band 170 comprises an annular shoulder 173 below the upper skirt 161 and an outer skirt portion 174 extending downwardly from the shoulder 173. The band 170 is joined to the upper skirt 161 by a frangible section which allows the band 170 to be at least partially tom from the cap. The frangible section includes a number of radially spaced bridges 176 interconnecting the shoulder 173 and the upper skirt portion, the bridges being provided by the lower edges of ribs 166. Alternatively, the frangible section may be provided by a line of weakness formed along the intersection of shoulder 173 and upper skirt 161. In the illustrated embodiment, the shoulder 173 and outer skirt portion 174 divide the band into two sections, with the outer skirt portion being oriented at an angle relative to the annular shoulder. In a modified embodiment, discussed in relation to FIG. 24, the tamper-evidencing band may comprise a single, curved section which extends generally outward and downward from the upper skirt portion. The tamper-evidencing band may also take many other forms.

The tamper-evidencing band includes a plurality of the internal ratchet teeth 181 depending from the shoulder 173. The generally downwardly depending teeth 181 are positioned to engage teeth 151 when cap 121 is pushed onto neck 122. Teeth 181 include an inclined surface 183 for facilitating the application of the cap to neck 122 and a working surface 184 which cooperates with the working surface of one of the teeth 151 on the neck to resist unscrewing of the closure. As the closure is moved downwardly on the neck, the inclined surface 183 slides along tooth 151 to thereby guide tooth 181 to a position between adjacent ones of teeth 151. The downward depending tooth 181 is retained between the teeth 151, with the interengagement between the teeth 151 and 181 securing cap 121 on the neck so long as the tamper-evidencing band 170 is intact. Teeth 181 are located on the shoulder in the present embodiment; however, the teeth may alternatively be positioned at other locations on the tamper-evidencing band 170, such as along the inner surface of outer skirt portion 174.

The interlocking engagement between the teeth on the cap with those on the neck prevents twisting of the cap relative to the container while the tamper-evidencing band 170 is intact. To remove the closure from the neck, the band 170 is at least partially removed from the upper skirt 161 to disengage teeth 181 from the teeth 151 on the neck. The separation of the tamper-evidencing band 170 from the upper skirt 161 is accomplished by rupturing the bridges 176. The ruptured bridges warn the consumer that the container has been opened and the contents tampered with.

A tear tab 186 is connected to the lower edge of the tamper-evidencing band 170. In the present embodiment, the tear tab provides means for removing the lower band and may additionally be used to orient cap 121 relative to the container prior to application if desired. The tamper-evidencing band 170 is formed with a line of weakness adjacent tab 186, generally indicated by 187, extending through outer skirt portion 174 and shoulder 173 of the band. The line of weakness facilitates removal of the band 170 from the closure, and is another tamper-evidencing feature of the present invention. When initially opening the container, the consumer pulls tab 186 to remove lower band 170, rupturing line 187 and frangible section 176. The absence of the band 170 more dramatically alerts the consumer to possible tampering with the contents. An inattentive consumer may fail to notice the fractured bridges, therefore the removal of the tamper-evidencing band is a more obvious indication of tampering. In the preferred form, completely removing lower band 170 from upper skirt 161 aesthetically enhances the appearance of cap 121, which is used to reseal the container. However, in other forms of the present invention the lower band may be only partially removed from the upper skirt portion for separating teeth 151 from teeth 181 to unscrew the cap from the container.

When a consumer desires to initially open the container, he grips tab 186 and pulls circumferentially around the container detaching lower band 170 from upper skirt 161. Ratchet teeth 181 are thereby removed from interlocking engagement with upward projecting teeth 151, enabling the consumer to unscrew cap 121 from neck 122 and providing evidence that the container has been opened. To replace the cap, the consumer merely reverses the direction of twisting.

Figure 20:
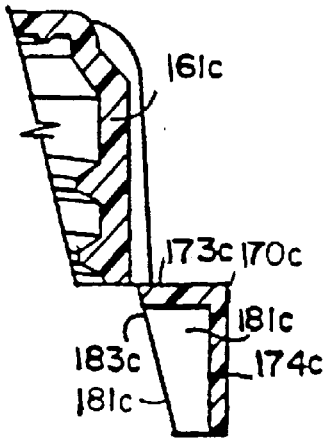
FIG. 20 is an enlarged, fragmentary sectional view taken along line 20—20 of FIG. 19.
Figure 19:
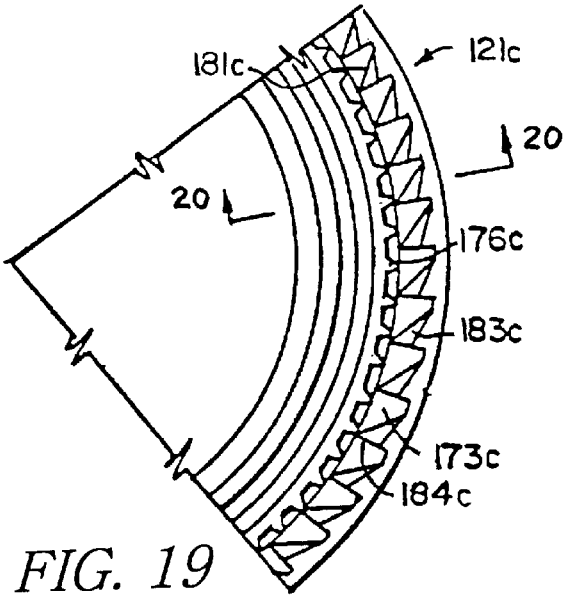
FIG. 19 is a fragmentary, bottom plan view of an another embodiment of a cap.

A modification of the cap is shown in FIGS. 19 and 20. The modified cap 121*c* may be applied to a container having a neck configuration similar to that shown in FIG. 18. The cap 121*c* includes a tamper-evidencing band 170*c* which includes a number of downward depending teeth 181*c*. The shoulder 173*c* of the band extends horizontally outward from the lower edge of upper skirt portion 161*c*, and the outer skirt portion 174*c* depends from the shoulder. A frangible section composed of a plurality of circumferentially spaced bridges 176*c* connects shoulder 173*c* to the lower edge of upper skirt 161*c*. The teeth 181*c* are dimensioned and positioned to engage the upwardly extending teeth 151 formed on the neck. To facilitate application of cap 121*c*, teeth 181*c* include a beveled inner surface 183*c*. When pushing the closure onto the neck, inner surface 183*c* directs the teeth 181*c* into interengagement with teeth 151. The working surface 184*c* engages the working surface of one of the teeth 151 on the neck to resist unscrewing of the cap 121*c* from the neck.

Teeth 181*c* and teeth 151 cooperate to restrain unscrewing of cap 121*c* relative to the neck while the lower skirt remains intact. To unscrew the cap, lower band 170*c* is removed from upper skirt portion 161*c* by rupturing frangible bridges 176*c*. The modified cap may include a tear tab and a line of weakness extending through the lower skirt, as described with reference to the previously discussed embodiment for facilitating removal of tamper-evidencing band 170*c*. Alternatively, cap 121*c* may be twisted, fracturing the bridges, and unscrewed from the container with lower band 170*c* remaining around neck 122. The use of a tear tab and line of weakness is preferred, as it provides a clearer and more obvious indication of tampering, facilitates recycling of the container and substantially eliminates risk of injury to wildlife.

Figure 21:
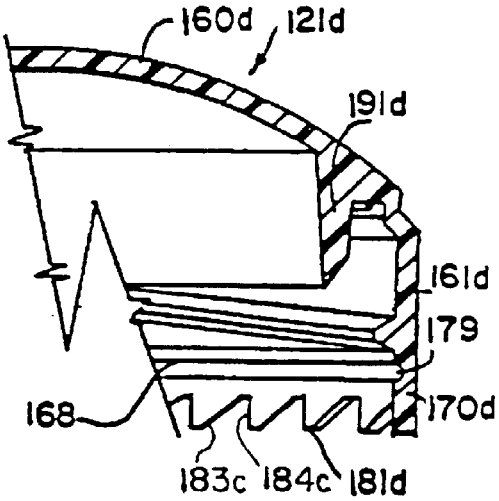
FIG. 21 is an enlarged, fragmentary side elevational view of an alternative embodiment of a cap, shown partly in cross section.
Figure 22:
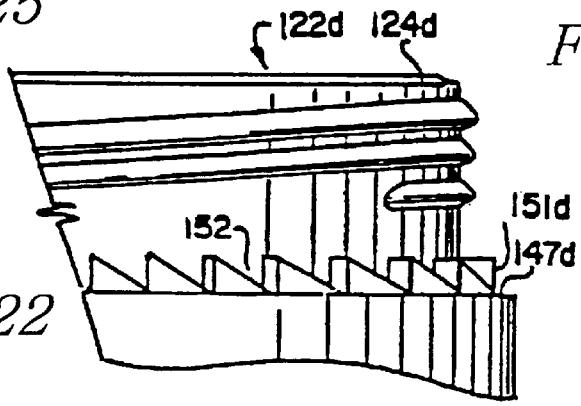
FIG. 22 is an enlarged, fragmentary side elevational view of an alternative embodiment of a neck.
Figure 23:
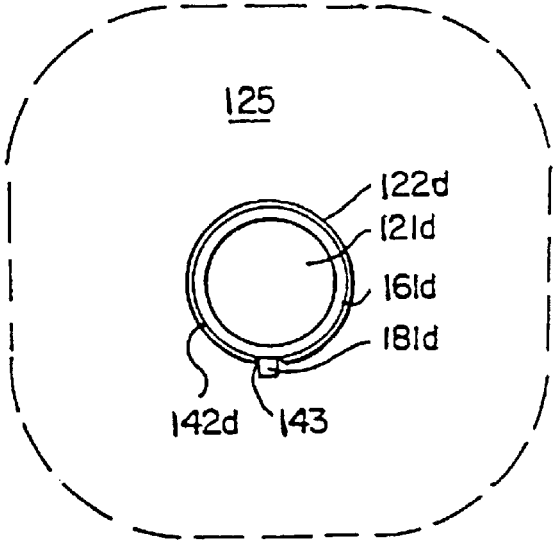
FIG. 23 is a fragmentary, top plan view showing the cap applied to a container.

An alternative modification of the cap 121*d* and neck 122*d* of the present invention is shown in FIGS. 21 to 23. Neck 122*d* is formed with several teeth 151*d* circumferentially spaced along shoulder stretch 147*d*. A pair of adjacent teeth 151*d* are separated by a space, generally designated 152, formed for receiving the teeth of the closure. When the closure is applied to the neck, a tooth formed on the closure is positioned within space 152 between the adjacent teeth 151*d*, thereby preventing rotation of the closure relative to the neck.

Cap 121*d* (FIG. 21) includes a domed top 160*d* having an inner skirt 191*d* depending from the underside of the domed top. Inner skirt 191*d* engages lip flange 124*d* when the cap seats on the neck, forming an internal seal between the cap and the neck. In this embodiment, the lower band portion

170*d* comprises a number of teeth 181*d* generally depending from lower edge 68 of upper skirt 61*d*. The tamper-evidencing means are provided by the teeth 181*d*. The teeth 181*d* are shaped and positioned for interengaging teeth 151*d*, with one tooth 181*d* slipping into space 52 as the cap 121*d* is applied to neck 122*d*. The teeth 181*d* have an inclined surface 83*d* which slides along the tooth 151*d* to position the tooth 181*d* in the space 52. The working surface 84*d* of the tooth engages the tooth 151*d* on the neck to resist unscrewing of the cap 121*d* relative to the neck 122*d*. The interengagement between teeth 151*d* and teeth 181*d* substantially restricts twisting of the closure relative to the neck, preventing unscrewing of the cap with the tamper-evidencing structure intact.

To remove cap 121*d* from neck 122*d*, the band 170*d*, which is formed with the downward depending teeth 181*d*, must be severed from upper skirt portion 161*d*. As is shown in FIG. 21, a line of weakness 179 extends about the circumference of the closure between the upper skirt portion 161*d* and the band 170*d*. To open the container for the first time, the band 170*d* is torn away at the line of weakness, facilitating unscrewing of the closure. Removal of the band 170*d* is facilitated by a tear tab which is gripped while initiating a continuing tearing away of the lower skirt portion. As is shown in FIG. 23, one of the downward extending teeth 181*d* may be extended to provide a tear tab. When the cap is applied to the neck, the tear tab is deformed outward by depressed section 143 of shoulder stretch 147*d*. The consumer grips the tear tab shown in FIG. 23 and removes the lower band portion 170*d* to separate the interengaged teeth 151*d* and 181*d* and open the container.

Figure 24:
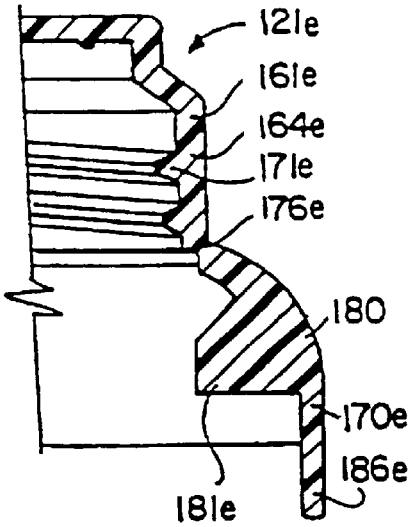
FIG. 24 is an enlarged, fragmentary side elevational view of another embodiment of a cap.

Another modification of a cap 121*e* of the present invention is shown in FIG. 24. The cap 121*e* may be used with a neck of the type shown in FIG. 18. The cap 121*e* includes an upper skirt 161*e* having a generally vertical portion 164*e* and a lower band portion 170*e*. The lower band 170*e* extends generally outward and downward from the lower edge of vertical portion 164*e*, and is formed with a curved section 180. A number of internal teeth 181*e* are formed on the interior of the curved section 180 of the lower band. A frangible section, provided in the present embodiment by a line of weakness 176*e*, joins the lower band 170*e* to the upper skirt portion 161*e*. A tear tab 186*e* depends from the lower band 170*e*. When the cap 121*e* is applied to the neck 122, threads 171*e* slip past and interengage threads 129. Curved section 180 slips over outward extending shoulder 142 and lower neck portion 146, with the teeth 181*e* being shaped and positioned to interengage teeth 151. As with the previously described modifications, to open the container the consumer pulls tab 186*e*, fractures the line of weakness 176*e* and separates the lower band from the upper skirt, disengaging teeth 181*e* from teeth 151.

Figure 25:
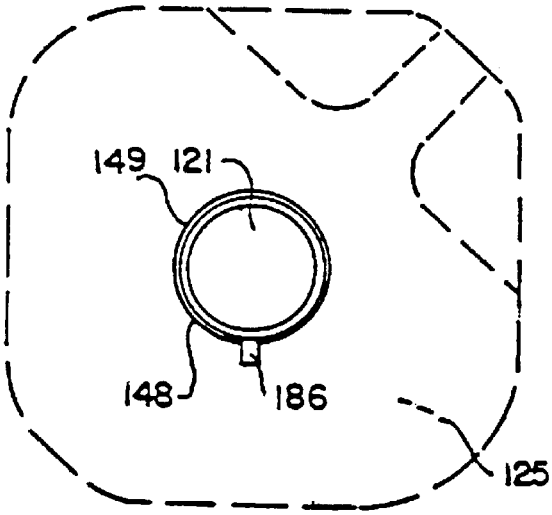
FIG. 25 is a top plan view of a cap applied to a container.

Turning to FIG. 25, cap 121 is shown seated on container 125. With the present invention, the closure may be conveniently oriented relative to the container prior to applying the closure to the neck. The tab 186 and the non-circular cross section of the container are directed by the capping machine during the capping process to align the cap and container relative to one another, positioning teeth 151 and 181 for direct interengagement when the cap is pushed onto the neck. However, the cap construction of the previous embodiments fosters substantial seating of the cap without prior orientation. For example, the locking means of the closure and neck are cooperatively shaped to slip past one another, thereby guiding the teeth 181 formed on the closure into interengagement with the teeth 151 formed on the neck. By first orienting the cap, full thread engagement may be achieved once the cap is pushed onto the neck. However, it is to be understood that in many instances, full thread engagement or complete interengagement of the teeth 151 and 181 is not necessary to securely retain the cap on the container. The various features of the present invention are not to be restricted to a snap-on, screw-off closure system in which the cap and container are first oriented relative to one another.

Figure 28:
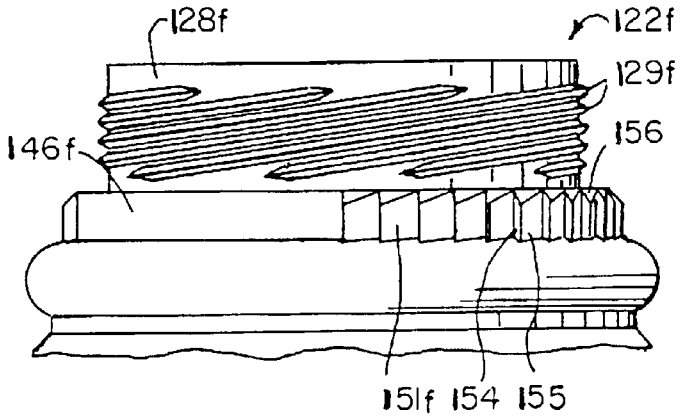
FIG. 28 is a side elevational view of another embodiment of a neck.
Figure 29:
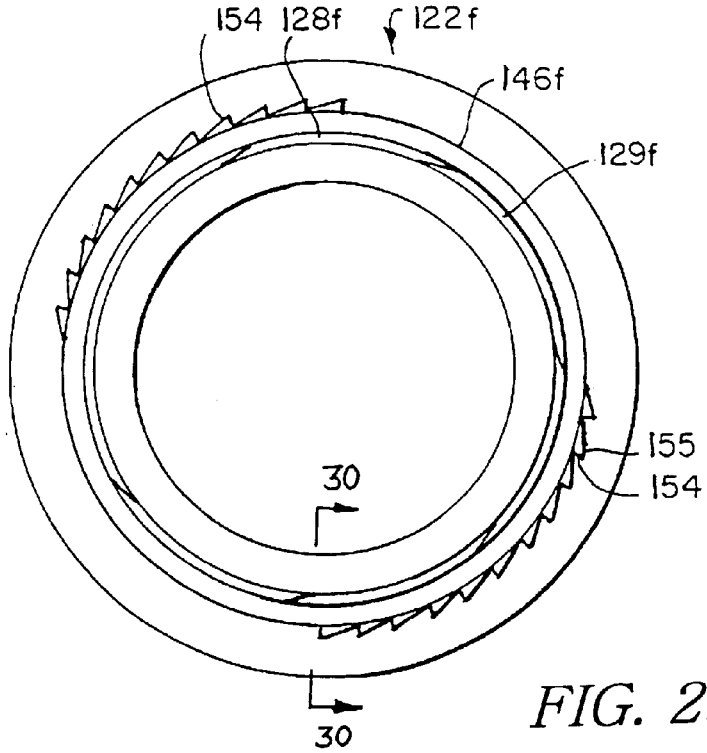
FIG. 29 is a top plan view of the neck of FIG. 28.

FIGS. 28–32 illustrate another embodiment of a neck 122*f* and cap 121*f* in accordance with the present invention. The neck 122*f* includes multiple threads 129*f* on the upper neck stretch 128*f*. As shown in FIG. 29, the neck 122*f* includes seven threads 129*f* although it is to be understood that a greater number of threads may be employed if desired. In this embodiment, the thread finish has a linear thread density of more than 17 threads per inch, for example 17.5 threads per inch, and each thread extends more than 200°, for example 215°, around the circumference of the upper neck stretch 128*f*. The thread density and length of each thread are also subject to variation within the scope of this invention.

A plurality of teeth 151*f* are formed on the locking wall 146*f* of the neck 122*f*. As shown particularly in FIG. 20, the teeth 151*f* include a working surface 154 and a trailing surface 155. The working surface 154 engages the working surface of a tooth on the cap to resist unscrewing of the cap relative to the neck. The trailing surface 155 joins the outer edge of the working surface 154 of one tooth 151*f* to the inner edge of the working surface 154 of the adjacent tooth as shown in FIG. 29. In other modifications of the invention, the teeth 151*f* may be spaced apart so that the trailing surface 155 ends at the locking wall 146*f* and is not joined to the adjacent tooth. The trailing edges 155 allow the cap 121*f* to be twisted slightly, usually no more than about 50°, to fully seat the cap on the neck after the cap has been substantially applied by pushing the cap in an axial direction onto the neck.

Figure 30:
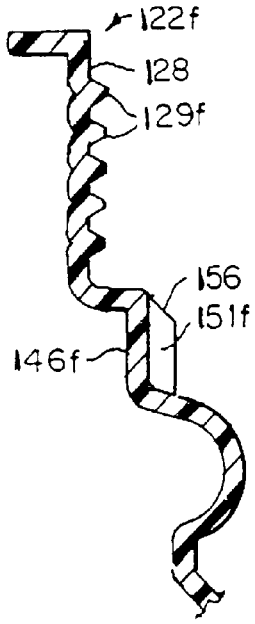
FIG. 30 is an enlarged, fragmentary sectional view taken along line 30—30 of FIG. 29.

As shown particularly in FIGS. 28 and 30, each tooth 151*f* includes a bevel 156 at the upper edge of the tooth 151*f*. The bevels 156 slant downwardly and outwardly to guide the cap teeth 181*f* into side-by-side interengagement with the teeth 151*f*. In the embodiment of FIGS. 28–30, the bevel 156 is inclined at an angle of about 40° to 50°, such as 45°, relative to a horizontal plane. However, a bevel of an angle in the range of 10° to 70° may be employed.

Figure 31:
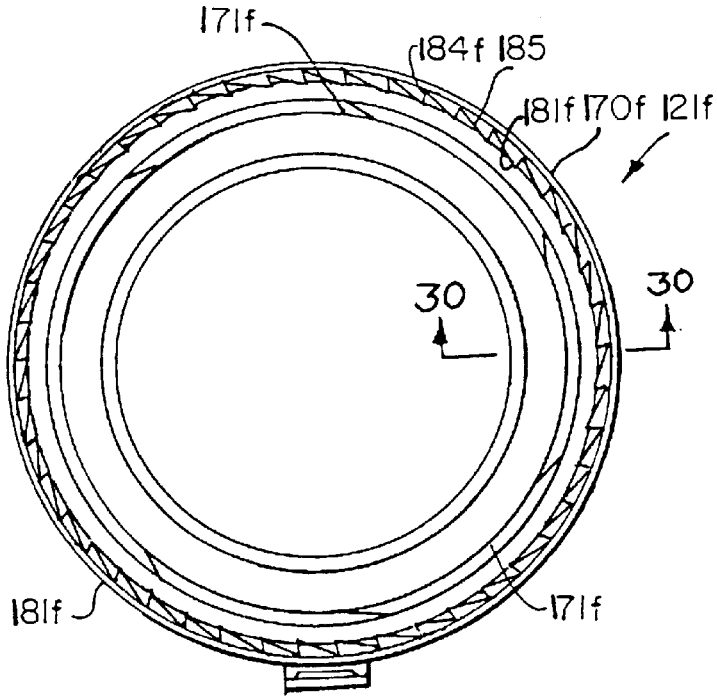
FIG. 31 is a bottom plan view of another embodiment of a cap.
Figure 32:
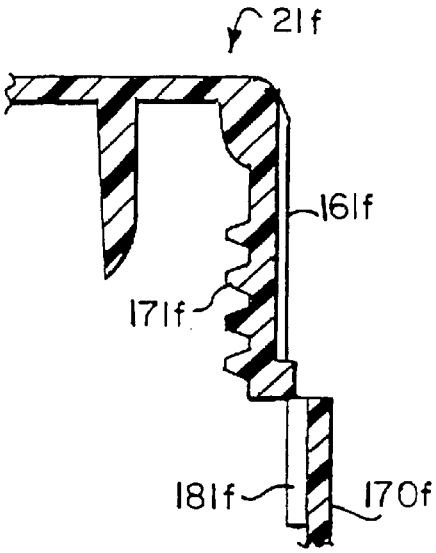
FIG. 32 is an enlarged, fragmentary sectional view taken along line 32—32 of FIG. 19.

The cap 121*f* is shown in FIGS. 31 and 32. The cap 121*f* includes multiple threads 171*f* on the interior of the upper skirt 161*f* which mate with the multiple threads 129*f* on the upper neck stretch 128*f*. In the illustrated embodiment, the cap 121*f* includes seven threads each having a length of about 180°, and the thread finish has a linear thread density of more than 17 threads per inch, such as 17.5 threads per inch. As with threads 129*f*, it is to be understood that the number of threads, the length of the individual threads, and the linear thread density is subject to considerable variation within the scope of the present invention.

A plurality of teeth 181*f* are provided on the interior of the tamper-evidencing band 170*f*. In the illustrated embodiment, teeth 181*f* are formed around the entire circumference of the band 170*f*, however in other embodiments the teeth 181*f* may be arranged in groups spaced around the interior of the band 170*f*. The teeth 181*f* have a working surface 184*f* and a trailing surface 185. The working surface 184*f* cooperates with the working surface 154 of the teeth 151*f* on the neck to resist unscrewing of the cap 121*f* from the neck 122*f*, while the trailing surface 185 joins the outer edge of the working surface 184*f* to either the inner edge of the working surface 184*f* of an adjacent tooth or ends at the inner wall of the band 170*f*. When the cap 121*f* is moved downwardly onto the neck 122*f* in an axial direction, the lower edge of some of the teeth 181*f* contact the bevel 156 on the teeth 151*f*, which guides the teeth 181*f* into side-by-side engagement with the teeth 151*f*.

Figure 33:
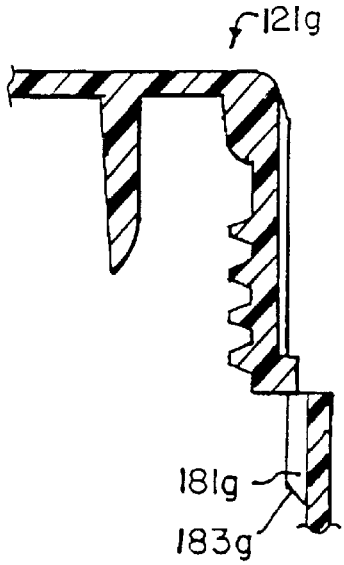
FIG. 33 is view similar to FIG. 32 of another embodiment of a cap.

In this embodiment shown in FIGS. 31 and 32, the downward slope of the working surface 184*f* and the trailing surface 185 follows the slope of the band 170*f*. In this instance, both the band 170*f* and the surfaces 184*f* and 185 are substantially vertical corresponding to the substantially vertical orientation of the locking wall 146*f*. However, the band 170*f* may also be slanted downwardly and outwardly as shown for example by the band 170 in FIGS. 1–5. The bottom or lower edge of the teeth 181*f* of the embodiment shown in FIGS. 31–32 is substantially horizontal. When the neck 122*f* is used with the cap 121*f*, the bevels 156 provide the primary means for guiding the teeth 151*f* and the teeth 181*f* into interengagement. The neck 122*f* may also be used with other caps such as a cap 121*g* shown in FIG. 33. The teeth 181*g* of the cap 121*g* have a bevel or inclined surface 183*g* which is slanted in a downward-outward direction. The bevel 183*g* cooperates with the bevel 156 to guide the teeth 151*f* and 181*g* into side-by-side interengagement. The neck 122*f* may also be used with caps of the type shown in FIGS. 13–18 and FIGS. 19–20, modified to include threads matching the thread pattern on the neck 121*f*.

Except as set forth above, the modifications of FIGS. 19–20, 21–23, 24, 28–32 and 33 resemble those of the preceding modifications and the same reference numerals followed by the subscripts c–g, respectively, are used to designate corresponding parts.

Preferred Operation II

Figure 26:
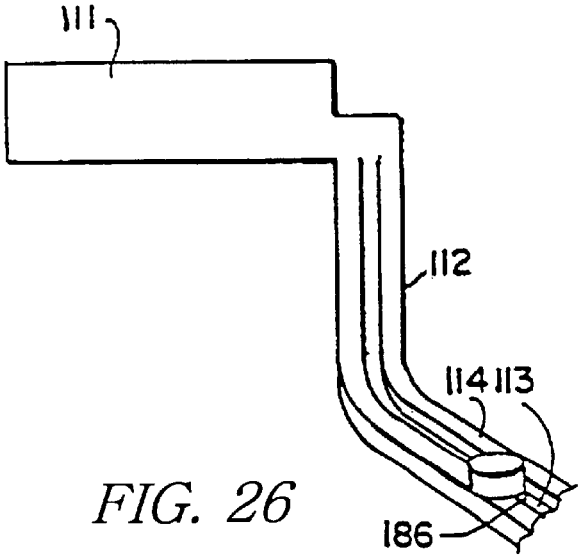
FIG. 26 is a fragmentary plan view of a capping machine, showing a cap positioned within the chute.

After the container has been filled, it is transported through a capping machine. The structure of capping machines is well known in the bottling art. As is well understood in the art, and in a manner similar to that whereby push-on, pull-off caps are applied, caps 121 are fed one at a time out of a bowl 111 in the capping machine along a chute 112 (FIG. 26). One type of chute 112 is formed with a slot 113 between parallel rails 114, with tear tab 186 orienting the caps for uniform discharge in a pre-determined orientation relative to the containers passing therebelow by fitting into the space 113 between the rails 114. Chutes without slots may be used when the tab does not depend from the lower edge of the tamper-evidencing band or when the cap is not oriented relative to the neck before it is applied.

Figure 27:
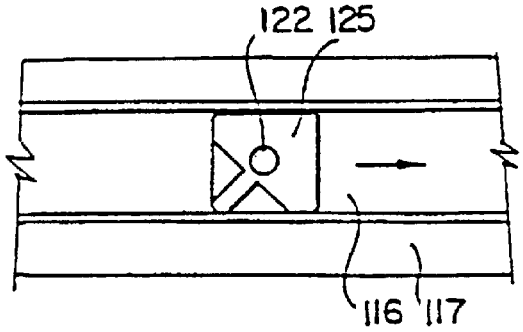
FIG. 27 is a partial top plan view of a capping machine, showing a container positioned on the conveyor belt.

When orientation is employed, each container 125 preferably has a non-circular cross section or some other variation from a round shape, such as the rectangular shape shown in FIG. 25, which permits the container to be oriented relative to cap 121. The container 125 travels along a conveyer belt 116 below the capping machine (FIG. 27). Guide rails 117 adjacent the conveyor belt 116 directionally align the non-circular cross section of the container 125 relative to the tear tab 186 of the cap. Using the slot 113 between the parallel rails 114 and the guide rails 117, the cap 121 and neck 122 may be conveniently oriented relative to one another by the conventional capping machine and conveyor belt system.

As is well known in the art, the container passes below the chute and picks up a cap 121 such that the cap is resting on the neck 122. If orientation is employed, the threads 129 and 181 are in vertical alignment, ensuring full thread engagement. Otherwise, the orientation of the cap relative to the neck is random. An axially downward force is applied to the cap, pushing the cap onto the neck without externally imposed relative rotation of the cap and container. Threads 171*a* and 171*b* slip over threads 129*a* and 129*b*, the slanted surfaces 136 facilitating such movement. The cap is sufficiently resilient so that it expands outward to permit the threads to slip. As cap 121 seats on the neck, teeth 181 fall behind teeth 151, providing interengagement between teeth 151 and teeth 181. The inclined surfaces 183 of teeth 181 and/or bevels 156 of teeth 151*f* guide the teeth 181 and 151, 151*f* into interengagement. After the cap has been fully seated on neck 122, it may not be removed without providing evidence of tampering. The interengagement between teeth 151 and 181 prevent unscrewing of the cap from the container, while the interengagement between the threads prevents lifting of cap 121 off neck 122.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, a container neck and a container closure, said neck having an upper opening, a downward extending neck stretch portion below said opening, said neck stretch portion having an exterior, at least one first helical engagement means around said exterior of said neck stretch portion, said at least one first helical engagement means having a lower surface, a locking wall portion below said neck stretch portion, at least one first tooth on said locking wall portion, said closure having a top, said top having an underside, a plug disposed centrally of said underside of said top dimensioned to fit inside said upper opening, a downward extending upper skirt portion depending from said top, said upper skirt portion having an interior, at least one second helical engagement means around said interior of said upper skirt portion shaped to mate with said at least one first helical engagement means, said at least one second helical engagement means having an upper surface, a lower skirt portion below said upper skirt portion, frangible means joining said upper and lower skirt portions together, at least one second tooth on said lower skirt portion shaped to engage said at least one first tooth to prevent unscrewing of said closure relative to said neck without breaking said frangible means, said at least one first and second helical engagement means being shaped to slip over each other upon direct axial downward movement of said closure on said neck without relative rotation of said closure and said neck and then to interengage, said plug having a contact point located on said plug where said plug first engages said neck opening when said closure is applied to said neck, said contact point and said upper surface of said at least one second helical engagement means being separated by a maximum vertical distance, a top of said neck opening and said lower surface of said at least one first helical engagement means being separated by a minimum vertical distance, said maximum vertical distance between said contact point and said upper surface of said at least one second helical engagement means is greater than said minimum vertical distance between said top of said neck opening and said lower surface of said at least one first helical engagement means, thereby ensuring engagement of said at least one first and second helical engagement means prior to contact between said plug and said neck opening.

2. The combination of claim 1 which further comprises means to remove said lower skirt portion from said closure, said means to remove said lower skirt portion comprising a tear tab connected to said lower skirt portion.

3. The combination of claim 1 in which said lower skirt portion is formed with a line of weakness extending through said lower skirt portion.

4. The combination of claim 3 in which said line of weakness is a vertical scoreline.

5. The combination of claim 1 in which said frangible means comprises a plurality of spaced bridges.

6. The combination of claim 1 in which said at least one first and second helical engagement means are multilead, whereby said closure tends to rest horizontally on said neck prior to said downward movement.

7. In combination, a container neck and a container closure, said neck having an upper opening, a downward extending neck stretch portion below said opening, said neck stretch portion having an exterior, at least one first helical engagement means around said exterior of said neck stretch portion, a locking wall portion below said neck stretch portion, at least one first tooth on said locking wall portion, said closure having a top, said top having an underside, a downward extending upper skirt portion depending from said top, said upper skirt portion having an interior, at least one second helical engagement means around said interior of said upper skirt portion shaped to engage with said at least one first helical engagement means, a lower skirt portion below said upper skirt portion, frangible means joining said upper and lower skirt portions together, at least one second tooth on said lower skirt portion shaped to engage said at least one first tooth to prevent unscrewing of said closure relative to said neck without breaking said frangible means, said at least one first and second helical engagement means being shaped to slip over each other upon direct axial downward movement of said closure on said neck without relative rotation of said closure and said neck and then to interengage, said closure being formed with an internal shoulder at the intersection of said underside of said top and said interior of said upper skirt portion, said shoulder engaging said neck stretch portion.

8. In combination, a container having a neck and a container closure, said neck having an upper opening, a lip surrounding said opening, a downward extending neck stretch below said lip, said neck stretch having an exterior, multiple neck helical engagement means on said exterior of said neck stretch, a locking wall below said neck stretch, and a plurality of external teeth on said locking wall, said closure having a top, a downward extending upper skirt depending from said top adapted to fit over said neck stretch, said upper skirt having an interior, multiple closure helical engagement means on said interior of said upper skirt shaped to engage said neck helical engagement means, a tamper-evidencing band frangibly attached to said upper skirt, a plurality of internal teeth on said tamper-evidencing band interengaging said external teeth to prevent unscrewing of said closure from said neck so long as said tamper-evidencing band is intact, said neck and closure helical engagement means being shaped and said closure being resilient so that upon application of force to accomplish direct, axial movement of said closure relative to said container without externally imposed relative rotation of said closure and said neck, said neck and closure helical engagement means slip past each other and then interengage and said closure seats on said neck so that said closure cannot be removed from said neck without unscrewing said closure, said external teeth having a bevel slanted downwardly and outwardly from said locking wall, said bevel guiding said internal teeth and said external teeth into side-by-side interengagement upon contact between at least one of said internal teeth and said bevel of at least one of said external teeth during said direct, axial movement of said closure relative to said neck.

9. In combination, a container and a closure:

said container including a neck having an opening, a neck stretch below said opening, and a first helical engagement structure on said neck stretch;

said closure having a skirt and a second helical engagement structure on said skirt;

said combination being adapted for snap-on application of said closure to said neck;

a plurality of first locking members located on one of said container and said closure;

a second locking member located on the other of said container and said closure; and alignment structure on one of said container and said closure adapted to direct said second locking member between adjacent ones of said plurality of first locking members upon application of said closure upon said container;

wherein said second locking member is adapted to engage at least one of said adjacent ones of said plurality of first locking members to prevent unscrewing of said closure relative to said neck until said second locking member is disengaged from said at least one first locking member.

10. The combination of claim 9, wherein said first and second helical engagement structures are screw threads.

11. The combination of claim 10, wherein said first and second screw threads each have a linear thread density of at least twelve threads per inch.

12. The combination of claim 11, said first and second screw threads being of sufficient length around an exterior of said container neck and an interior of said skirt, respectively, to provide at least 400° of thread engagement.

13. The combination of claim 9, wherein said first and second helical engagement structures are multi-lead threads, whereby said closure tends to rest horizontally on said neck prior to said snap-on application of said closure upon said neck.

14. The combination of claim 9, wherein said closure includes a cap top and an internal shoulder vicinal the intersection of cap top and said skirt, said internal shoulder engaging said neck.

15. The combination of claim 9, wherein said first and second helical engagement structures are dimensioned and configured to slip over each other upon direct axial downward movement of said closure on said neck without externally imposed relative rotation of said closure and said neck allowing said snap-on application of said closure to said neck.

16. The combination of claim 9, wherein said first and second helical engagement structures are dimensioned and configured to slip over each other upon direct axial downward movement of said closure on said neck without externally imposed relative rotation of said closure and said container and then interengage each other so that said closure can be removed from said container by unscrewing said closure from said neck.

17. The combination of claim 9, said container further comprising a locking wall below said neck stretch, said plurality of said first locking members being located on said locking wall.

18. The combination of claim 17, said closure further comprising a tamper-evidencing band below said skirt, said second locking member being located on said tamper-evidencing band.

19. The combination of claim 18, said closure further comprising a tear tab connected to said tamper-evidencing band for tearing said tamper-evidencing band from said skirt.

20. The combination of claim 19, wherein said tamper-evidencing band is includes with a line of weakness extending through said tamper-evidencing band vicinal said tear tab for splitting said tamper-evidencing band during removal of said tamper-evidencing band from said skirt.

21. The combination of claim 20, wherein said line of weakness is a vertical scoreline.

22. The combination of claim 18, said closure further comprising a frangible connection joining said skirt and said tamper-evidencing band.

23. The combination of claim 22, wherein said frangible connection comprises a plurality of spaced bridges interconnecting said skirt and said tamper-evidencing band.

24. The combination of claim 22, said closure further comprising a shoulder interconnecting said tamper-evidencing band and said skirt, and at least one substantially vertical fin joined to and upstanding from said should to prevent upward deformation of said tamper-evidencing band without breaking said frangible connection.

25. The combination of claim 22, wherein said second locking member includes an interlocking edge on said tamper-evidencing band and each said first locking members includes an interlocking surface, said interlocking edge being shaped to engage at least one of said interlocking surfaces to prevent removal of said closure from said container until said frangible connection is broken.

26. The combination of claim 25, wherein said first and second helical engagement structures are adapted to pass over each other in a series of at least two snap actions upon downward movement of said closure relative to said container, wherein after the first of said snap actions said interlocking edge of said closure is positioned to at least partially engage said interlocking surface of said container upon rotation of said closure with respect to said container neck.

27. The combination of claim 22, wherein said first locking members include external teeth on said locking wall and said second locking member includes an internal tooth on said tamper-evidencing band, said internal tooth being shaped to engage at least one of said external teeth to prevent removal of said closure from said container until said frangible connection is broken.

28. The combination of claim 27, wherein said closure comprises a plurality of internal teeth on said tamper-evidencing band, said internal teeth shaped to engage said external teeth to prevent removal of said closure from said container until said frangible connection is broken.

29. The combination of claim 28, wherein said external teeth include a working surface engaging one of said internal teeth and a trailing surface joined to said working surface.

30. The combination of claim 28, wherein said internal teeth have an inclined surface for guiding said external teeth into side-by-side interengagement upon contact between said inclined surface of said internal teeth and at least one of said external teeth.

31. The combination of claim 28, wherein said external teeth include a bevel slanted downwardly and outwardly from said locking wall, said bevel guiding said internal teeth and said external teeth into side-by-side interengagement upon contact between at least one of said internal teeth and said bevel of at least one of said external teeth during said direct, axial movement of said closure relative to said neck.

32. The combination of claim 9, wherein said closure includes a cap top and a plug disposed centrally of said cap top, said plug having a contact point located on said plug where said plug first engages an upper end of said container neck when said closure is applied to said neck, said contact point and an upper surface of said second engagement structure being separated by a maximum vertical distance, said upper end of said container neck and a lower surface of said first engagement structure being separated by a minimum vertical distance, said maximum vertical distance being greater than said minimum vertical distance thereby ensuring engagement of said first and second helical engagement structure prior to contact between said plug and said upper end of said container neck.

33. The combination of claim 9, said combination further comprising first orientation structure on said container and second orientation structure on said closure, one of said first and second orientation structures being positioned to be directionally engaged by the other of said first and second external orientation structures to orient said closure relative to said container so that, upon snap-on application of said closure on said neck, said second locking member engages said at least one first locking member to prevent unscrewing of said closure from said neck until said tamper-evidencing band is removed from said closure.

* * * * *